US006415567B1

(12) United States Patent
Mead et al.

(10) Patent No.: US 6,415,567 B1
(45) Date of Patent: Jul. 9, 2002

(54) FURNITURE POST TOP CAP ATTACHMENT AND TRIM REGISTRY

(75) Inventors: Karl J. Mead, East Grand Rapids; Marvin C. Knauf, Conklin; Thomas R. Maas, Grandville, all of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/611,490

(22) Filed: Jul. 7, 2000

(51) Int. Cl.[7] ..... E04H 1/02; E04H 1/12

(52) U.S. Cl. ..... 52/239; 52/238.1; 52/243; 52/271; 52/285.1; 52/285.2; 160/135; 160/351

(58) Field of Search ..... 52/36.1, 36.4, 52/36.5, 238.1, 239, 243, 242, 271, 270, 731.9, 285.1, 285.2, 285.3; 160/135, 351

(56) References Cited

U.S. PATENT DOCUMENTS

| | | | | | |
|---|---|---|---|---|---|
| 1,500,377 | A | * | 7/1924 | Dodson | 52/243 |
| 3,256,659 | A | * | 6/1966 | Dudoff | 52/239 |
| 3,566,561 | A | | 3/1971 | Tozer | |
| 4,104,838 | A | * | 8/1978 | Hage et al. | 52/239 |
| 4,455,102 | A | * | 6/1984 | Baroi et al. | 403/173 |
| 4,601,146 | A | * | 7/1986 | Harter et al. | 52/239 |
| 4,719,731 | A | * | 1/1988 | Ravotti et al. | 52/239 |
| 4,949,519 | A | * | 8/1990 | Jeffers | 52/239 |
| 5,067,294 | A | * | 11/1991 | McGowan | 52/241 |
| 5,195,286 | A | * | 3/1993 | Delong et al. | 52/220 |
| 5,347,778 | A | | 9/1994 | Bray | |
| 5,586,593 | A | | 12/1996 | Schwartz | |
| 5,746,035 | A | | 5/1998 | Seiber et al. | |
| 5,839,240 | A | | 11/1998 | Elsholz et al. | |
| 5,867,955 | A | | 2/1999 | Russell | |
| 5,875,596 | A | | 3/1999 | Muller | |
| 6,141,926 | A | | 11/2000 | Rossier et al. | |
| 6,167,665 | B1 | | 1/2001 | Dame et al. | |
| 6,250,032 | B1 | * | 6/2001 | Davis et al. | 52/239 |

FOREIGN PATENT DOCUMENTS

| | | | | |
|---|---|---|---|---|
| GB | 0675016 | * | 7/1952 | 52/243.1 |
| JP | 405163776 | * | 6/1993 | 52/238.1 |

* cited by examiner

*Primary Examiner*—Carl D. Friedman
*Assistant Examiner*—Phi Dieu Tran A
(74) *Attorney, Agent, or Firm*—Price, Heneveld, Cooper, DeWitt & Litton

(57) ABSTRACT

A partition for spatially dividing open building space and the like including a plurality of frames having adjacent frame ends interconnected by vertically spaced connector brackets to define a post-simulating joint and a trim system for the plurality of frames. The trim system includes a locator bracket and at least one side trim strip. The locator bracket is shaped to be attached to one of the connector brackets and includes upstanding side walls with outward extending upper tabs. The at least one side trim strip is shaped to enclose an associated open side of the post-simulating joint and includes at least one inwardly protruding top tab, each top tab mating and abutting at least one of the upper tabs of the locator bracket to positively locate the at least one side trim strip with respect to the adjacent frame ends.

37 Claims, 14 Drawing Sheets

FURNITURE POST TOP CAP ATTACHMENT AND TRIM REGISTRY

BACKGROUND OF THE INVENTION

The present invention relates to the finishing or fitting-out of building space and the like of the type having a generally open plan interior, and in particular to a furniture post that is readily fitted at the installation site.

The finishing or fitting-out of building spaces for offices, medical treatment facilities, and other areas where work is conducted has become a very important aspect of effective space planning and layout. Work patterns, technology, and business organizations are constantly evolving and changing. The building space users require products which facilitate change at lower cost, yet provide the privacy and aesthetic advantages of permanent floor-to-ceiling architectural wall systems. Space planning is no longer a static problem. Changing technology and changing work processes demand that a design and installation be able to support and anticipate change.

These space planning challenges are driven largely by the fact that modern office spaces are becoming increasingly more complicated and sophisticated due to increasing needs of the users for improved utilities support at each workstation or work setting. These "utilities," as the term is used herein, encompass all types of resources that may be used to support or service a worker, such as communications and data used with computers and other types of data processors, telecommunications, electronic displays, etc., electrical power, conditioned water, and physical accommodations, such as lighting, HVAC, sprinklers, security, sound masking, and the like. For example, modern offices for highly skilled "knowledge workers" such as engineers, accountants, stock brokers, computer programmers, etc., are typically provided with multiple pieces of very specialized computer and communications equipment that are capable of processing information from numerous local and remote data resources to assist in solving complex problems. Such equipment has very stringent power and signal requirements, and must quickly and efficiently interface with related equipment at both adjacent and remote locations. Work areas with readily controllable lighting, HVAC, sound masking, and other physical support systems are also highly desirable to maximize worker creativity and productivity. Many other types of high technology equipment and facilities are also presently being developed which will need to be accommodated in the work places of the future.

The efficient use of building floor space is also an ever-growing concern, particularly as building costs continue to escalate. Open office plans have been developed to reduce overall office costs, and generally incorporate large, open floor spaces in buildings that are equipped with modular furniture systems, which are readily reconfigurable to accommodate the ever-changing needs of a specific user, as well as the divergent requirements of different tenants. One arrangement commonly used for furniture open plans includes movable partial height partition panels that are detachably interconnected to partition off the open spaces into individual work settings and/or offices. Such partial height partition panels are configured to receive hang-on furniture units, such as worksurfaces, overhead cabinets, shelves, etc., and are generally known in the office furniture industry as "systems furniture." Another arrangement for dividing and/or partitioning open plans involves the use of modular furniture, in which a plurality of differently shaped, complementary freestanding furniture units are positioned in a side-by-side relationship, with upstanding partial height privacy screens available to attach to selected furniture units to create individual, distinct work settings and/or offices. All of these types of modular furniture systems have been widely received due largely to their ability to be readily reconfigured and/or moved to a new site, since they are not part of a permanent leasehold improvement.

In order to gain increased efficiency in the use of expensive office real estate, attempts are now being made to try to support highly paid knowledge workers with these types of modular furniture systems in open office settings, instead of conventional private offices. However, in order to ensure peak efficiency of such knowledge workers, the work settings must be equipped with the various state-of-the-art utilities and facilities discussed above. Since such work settings must be readily reconfigurable to effectively meet ever-changing needs, distribution and control of utilities throughout a comprehensive open office plan has emerged as a major challenge to the office furniture industry. The inherent nature of modular furniture systems, which permits them to be readily reconfigurable into different arrangements, makes it very difficult to achieve adequate utility distribution and control.

Hence, utility distribution and control are fast becoming one of the major issues in office fit-out and furniture. Changing technology is creating greater demands on power and signal distribution networks. Routing power and signal distribution below the floor or in furniture systems often ends up in complex idiosyncratic systems which are difficult to manage or change. Furthermore, due to dimension variations in existing permanent building walls, ceiling, and floors, space-dividing systems must be adaptable to accommodate these variables. There is presently an oversupply of office space and furniture systems which do not properly respond to or support change. Many older buildings do not have adequate utility capabilities, and the cost of conventional renovations or improvements often renders the same impractical. Even relatively new buildings can be quickly rendered obsolete by the fast paced changes in modern technology. The refurbishing of existing building space is therefore a concern which must be addressed by furniture systems.

Furthermore, interiors of the furniture systems should be accessible for routing utility, power or signal distribution systems through the furniture systems. In order to allow adaptability for changing building spaces, furniture systems should be accessible after the a portion of the furniture systems has been set in place. Prior furniture systems have included removable covers and trim for allowing office workers entrance to the interior of the furniture systems in order to reroute or reroute the utility, power or signal distribution systems. Some of these furniture systems, however, included covers and trim that were difficult to set in place upon construction of the furniture system or to realign or set in place once the covers or trim have been removed to route or reroute the systems.

Accordingly, an apparatus solving the aforementioned disadvantages and having the aforementioned advantages is desired.

SUMMARY OF THE INVENTION

One aspect of the present invention is to provide a partition for spatially dividing open building space and the like including a plurality of frames having adjacent frame ends interconnected by vertically spaced connector brackets to define a post-simulating joint and a trim system for the plurality of frames. The trim system includes a locator bracket and a side trim strip. The locator bracket is shaped to be attached to one of the connector brackets and includes upstanding side walls with outward extending upper tabs. The side trim strip is shaped to enclose an associated open side of the post-simulating joint and includes at least one inwardly protruding top tab, with each top tab mating and abutting at least one of the upper tabs of the locator bracket to positively locate the side trim strip with respect to the adjacent frame ends.

Another aspect of the present invention is to provide a partition for spatially dividing open building space and the like including a plurality of partition panels having adjacent frame ends. A plurality of connector brackets located at separate discrete locations interconnect adjacent ones of the frame ends to define a post-simulating joint. A vertically elongated trim piece is connected to the connector brackets and includes an outwardly projecting tab. Furthermore, a vertically registering bracket is located within the post-simulating joint. The tab of the trim piece is adapted to vertically overlap a portion of the vertically registering bracket to positively vertically align the trim piece with respect to the adjacent frame ends.

Yet another aspect of the present invention is to provide a method of joining at least one trim piece to a plurality of partition panels having adjacent frame ends includes interconnecting the frame ends of the partition panels at separate discrete locations with at least one connector brackets to thereby define a post-simulating joint. The method also includes registering the at least one side trim piece at a proper vertical location by vertically overlapping a tab of the at least one side trim piece with a portion of a vertically registering bracket located within the post-simulating joint. Furthermore, the method includes securing the at least one side trim piece to the connector brackets.

The principal objects of the present invention include providing an improved trim system for partition panels. The trim system allows the installer of the partition panels to easily locate the trim system in a proper position on a partition panel upon construction of the partition panel. The trim system further allows the trim system to easily be placed in position once the trim system has been removed for access to the interior of the partition system. The trim system can be easily and quickly assembled. The trim system provides simple construction and assembly without tools. The trim system is efficient in use, economical to manufacture, capable of a long operable life, and particularly adapted for the proposed use.

These and other features, advantages and objects of the present invention will be further understood and appreciated by those skilled in the art by reference to the following specification, claims and appended drawings.

DETAILED DESCRIPTION OF THE PREFERRED EMBODIMENT

For purposes of description herein, the terms "upper," "lower," "right," "left," "rear," "front," "vertical,"

Figure 1:
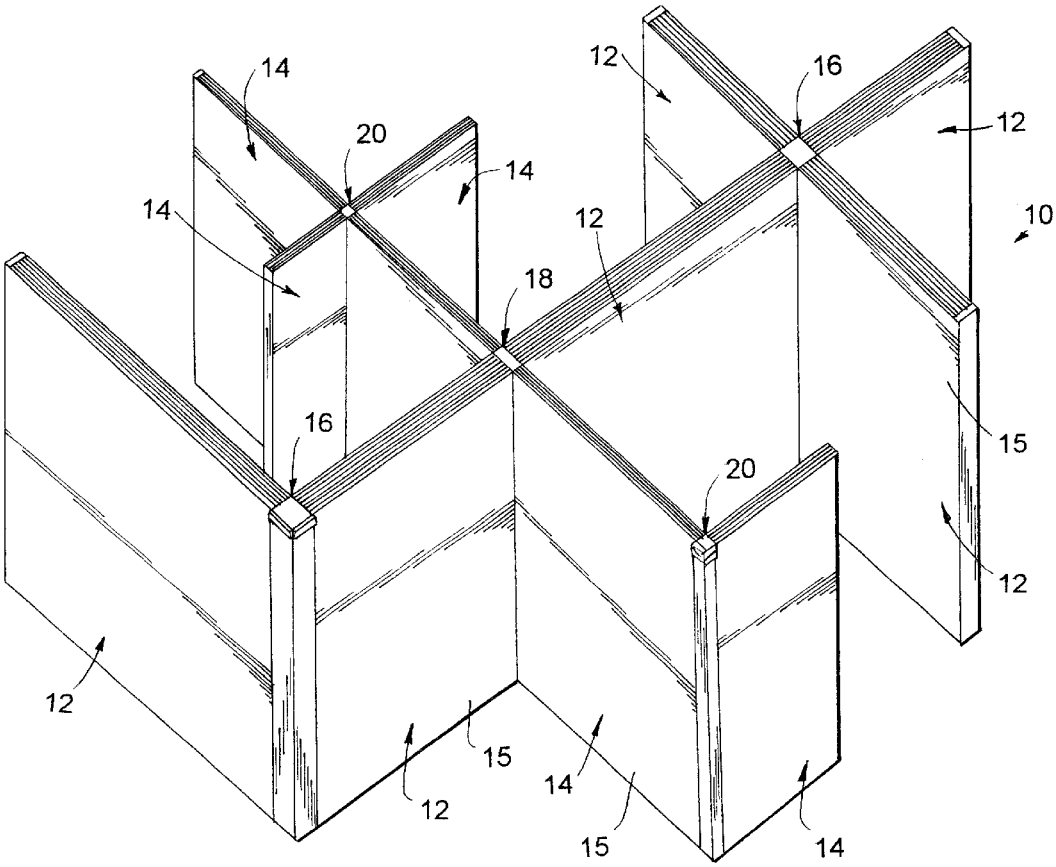
FIG. 1 is a perspective view of a partition system embodying the present invention.

"horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIG. 1) generally designates a partition system embodying the present invention. In the illustrated example, the partition system 10 includes large width partition panels 12 and small width partition panels 14 that each include cover panels 15 and that can be used to separate an office space into several different work areas. The large width partition panels 12 intersect each other at a large intersection 16, the large width partition panels 12 intersect the small width partition panels 14 at a medium intersection 17 and the small partition panels 14 intersect each other at a small intersection 18. The intersections 16–18 can include two or more intersecting panels. An example of the large width partition panel 12 is covered in the subject matter of commonly assigned U.S. Pat. No. 5,839,240, hereby incorporated by reference. Likewise, an example of the small width partition panel 14 is covered in the subject matter of commonly assigned U.S. Pat. No. 5,746,035, hereby incorporated by reference. It is contemplated, however, that many different designs can be used for the large width partition panels 12 and the small width partition panels 14.

Figure 2:
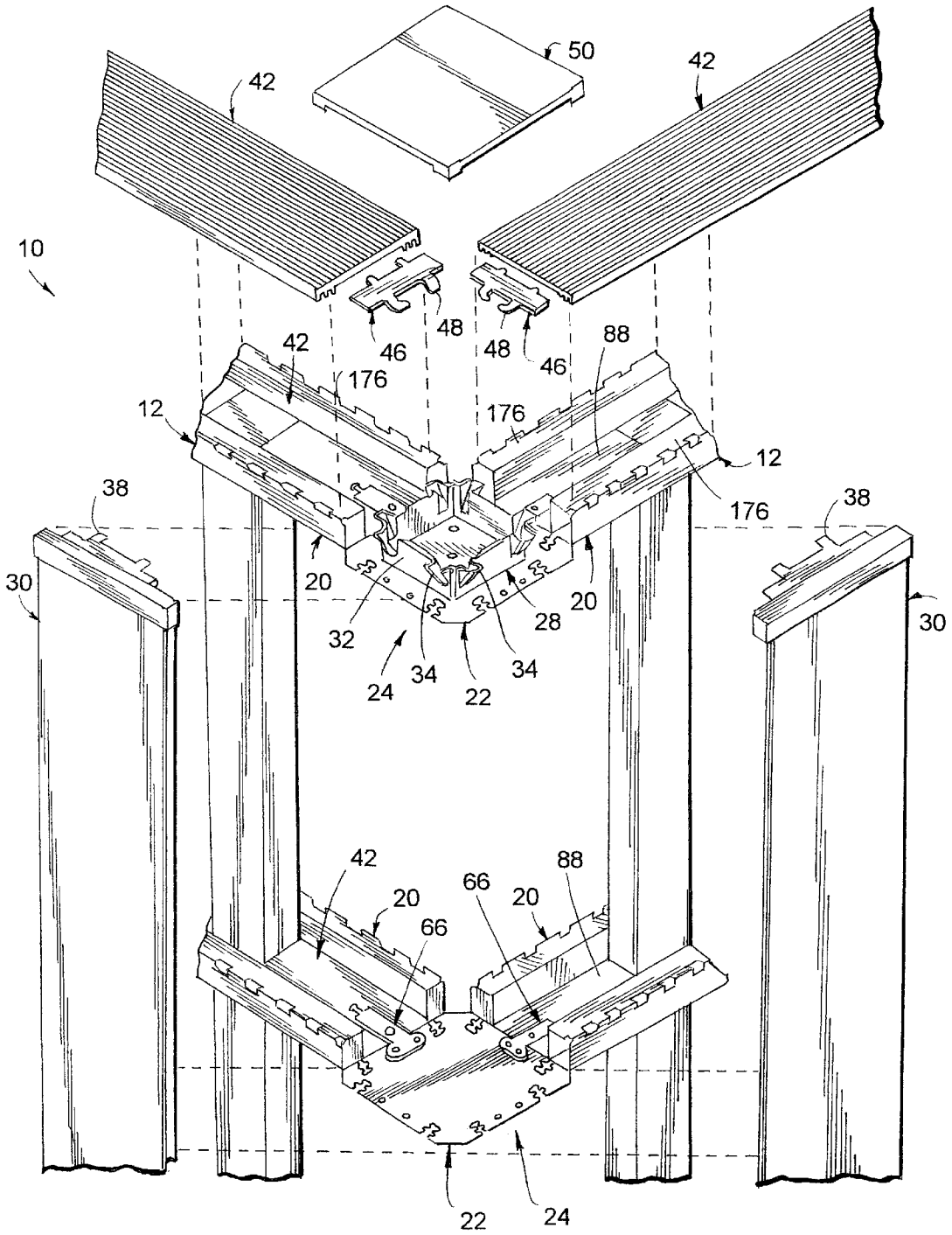
FIG. 2 is an exploded view of interconnecting partition panels of the partition system embodying the present invention.

As seen in FIG. 2, the large width partition panels 12 (with the cover panels 15 removed) have adjacent frame ends 20 interconnected by vertically spaced connector brackets 22 to define a post-simulating joint 24. Although FIG. 2 shows the interconnection of the large width partition panels 12 as including two large width partition panels 12, the interconnected adjacent frame ends 20 can include two or more interconnected panels. The illustrated partition system 10 includes a trim system having a locator bracket 28 and a side trim strip 30. The locator bracket 28 is shaped to be attached to one of the connector brackets 22 and includes upstanding side walls 32 with outward extending upper tabs 34. The side trim strip 30 is shaped to enclose an associated open side of the post-simulating joint 24 and includes inwardly protruding top tabs 38 for mating and abutting the upper tabs 34 of the locator bracket 28 to positively locate the side trim strip 30 with respect to the adjacent frame ends 20. The illustrated trim system 26 also includes a top trim strip 40 for connection to an associated open top 42 of the large width partition panels 12. An in-line connector 46 with inwardly facing tabs 48 is engaged with the top trim strip 40 by being slid into the top trim strip 40. In the illustrated example, each of the inwardly facing tabs 48 mate and abut one of the upper tabs 34 of the locator bracket 28. The trim system 26 also includes a top cap 50 shaped to enclose a top portion of the post-simulating joint 24. The top cap 50 is configured to be abuttingly supported on the top tabs 38 of the side trim strip 30 and the tabs 48 of the in-line connector 46 to positively locate the top cap 50.

The illustrated locator bracket 28 (FIG. 3) includes a bottom platform 54, the upstanding side walls 32 and the outward extending upper tabs 34. The illustrated bottom platform 54 is square and the side walls 32 extend upwardly from the periphery of the bottom platform 54. The bottom platform 54 includes a plurality of apertures 55 for insertion of fasteners 57 (see FIG. 4) for attaching the locator bracket 28 to the uppermost connector bracket 22. The outward extending upper tabs 34 have a U-shaped transverse cross-section that includes a base 56 and two perpendicular legs 58. Each side wall 32 includes two of the outward extending upper tabs 34, one adjacent each end of the side wall 32. The base 56 of the upper tabs 34 extends upwardly and outwardly at an angle from the side wall 32. Each leg 58 extends between and is substantially perpendicularly to each side of the base 56 and the side walls 32. Top edges 60 of the upper tabs 34 are aligned with top edges 62 of the side walls 32 in order to facilitate the mating of the upper tabs 34 of the locator bracket 28 with the top tabs 38 of the side trim strip 30 and the tabs 48 of the in-line connector 46. Each of the upper tabs 34 also has a beam 65 extending from the bottom of the base 56 in a direction substantially parallel to the legs 58. The beam 65 extends downward from the base 56 of the upper tab 34 to a level equal with the bottom of the bottom platform 54, thereby providing support for the upper tabs 34 when the locator bracket 28 is connected to the connector bracket 22. The side walls 32 also include a first set of abutment flanges 64 extending upwardly from the middle each of the side walls 32 between two of the upper tabs 34. A second set of abutment flanges 67 extend upward along the corners of the side walls 32 and one leg 58 of each adjacent upper tabs 34. As explained in more detail below, the first set of abutment flanges 64 and the second set of abutment flanges 67 help to support the top cap 50.

Figure 3:
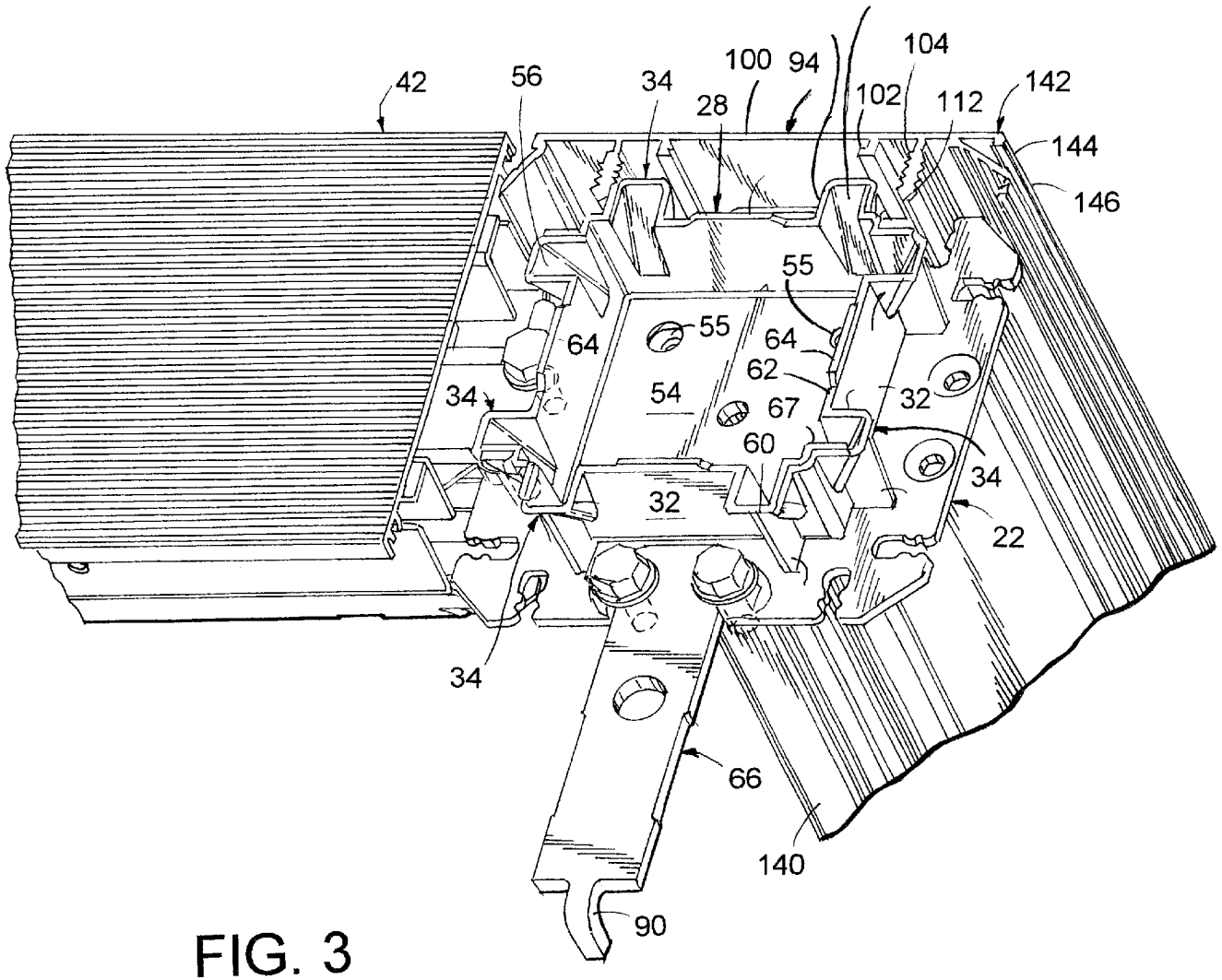
FIG. 3 is a perspective view of a locator bracket, a side trim portion, a connector bracket, a top trim strip, a frame end and a hook bracket embodying the present invention.
Figure 4:
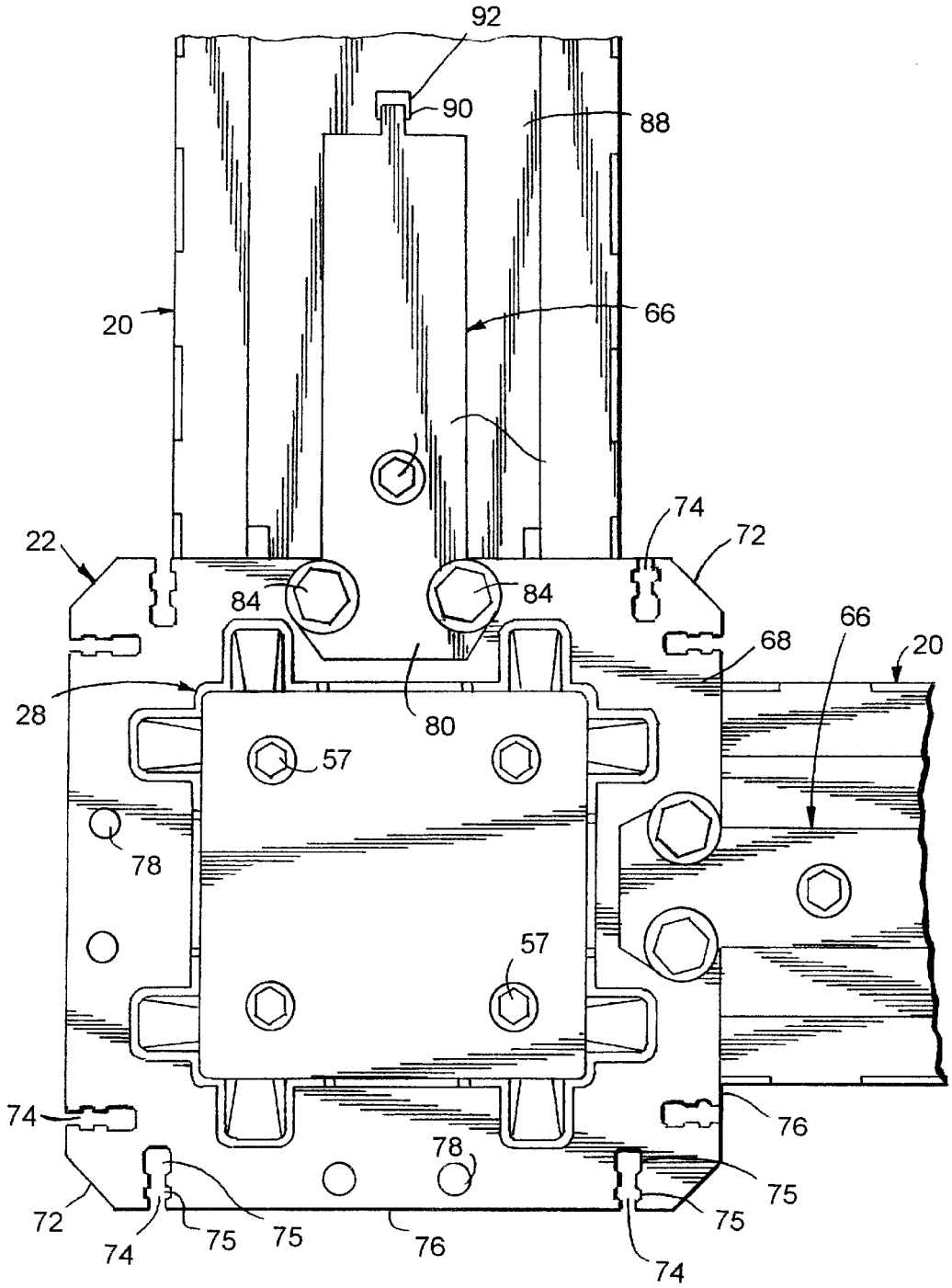
FIG. 4 is a top view of adjacent frame ends, the connector bracket and the hook bracket embodying the present invention.

As illustrated in FIGS. 2–4, the locator bracket 28 is attached to the uppermost one of the connector brackets 22, and the connector brackets 22 are attached to the adjacent frame ends 20 by a T-shaped hook bracket 66. The illustrated connector bracket 28 includes a substantially square plate 68 having the locator bracket 28 attached to a top surface of the square plate 68 by fasteners 57. The square plate 68 also includes beveled corners 72 and a pair of grooved slots 74 in each side edge 76 of the square plate 68 adjacent the beveled corners 72. As explained in more detail below, the grooved slots 74 include grooves 75 used to connect the side trim strips 30 to the connector brackets 22. A pair of apertures 78 are located adjacent each side edge 76 of the square plate 68 between the grooved slots 74. The T-shaped hook brackets 66 include a top section 80 connected to the locator bracket 22 and a perpendicular leg 82 attached to the frame end 20. A pair of fasteners 84 extend through the top section 80 of the T-shaped hook bracket 66 and into the apertures 78 of the connector bracket 22 to attach the hook bracket 66 to the connector bracket 22. A fastener 86 also extends through the leg 82 of the hook bracket 66 and into a bottom plate 88 of the frame end 20, thereby securing the connector bracket 22 and the hook bracket 66 to the large width partition panel 12. The hook bracket 66 also includes a downward facing hook 90 distal the top portion 80 that hooks into an opening 92 in the bottom plate 88 of the frame end 20. The hook 90 prevents rotation of the T-shaped hook bracket 66 and eliminates the need for more than one fastener 86 securing the T-shaped hook bracket 66 to the frame end 20. It is noted that the T-shaped hook brackets 66 and the connector brackets 22 are the subject matter of commonly assigned U.S. Pat. No. 5,867,955, hereby incorporated by reference.

Figure 5:
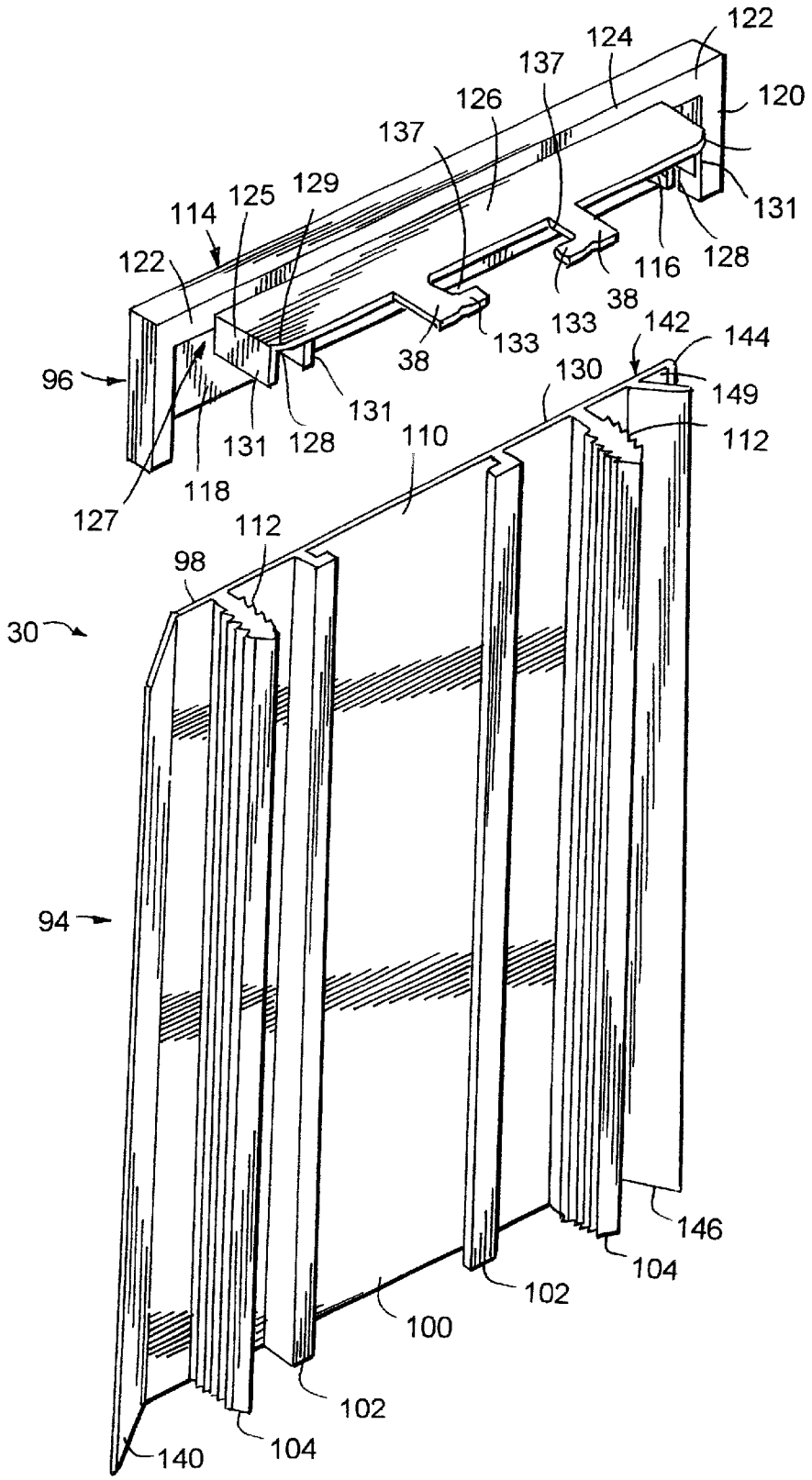
FIG. 5 is a perspective view of a side trim strip embodying the present invention.
Figure 6:
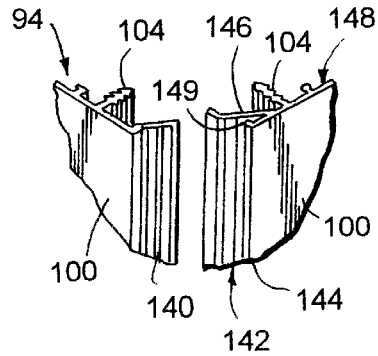
FIG. 6 is a perspective view of adjacent side trim portions before joining embodying the present invention.
Figure 7:
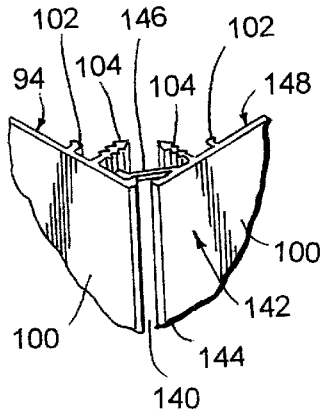
FIG. 7 is a perspective view of adjacent side trim portions after joining embodying the present invention.

The illustrated side trim strip 30 (FIG. 5) includes an extended side trim portion 94 shaped to enclose the associated open side 36 of the post-simulating joint 24 and a top transition cap 96 attached to a top edge 98 of the side trim portion 94. The side trim portion 94 includes a substantially planar plate 100 having a pair of centrally located abutment flanges 102 and a pair of attachment flanges 104. The pair of attachment flanges 104 extend vertically along an inside surface 110 of the plate 100. The attachment flanges 104 include barbs 112 projecting from the side faces of the attachment flange 104. As seen in FIG. 3, the barbs 112 connect the side trim portion 94 to the connector brackets 22 by inserting the attachment flanges 104 into the grooved slots 74 in each side edge 76 of the square plate 68 of the connector brackets 22. The barbs 112 extend into the grooves 75 to frictionally secure the side trim portion 94 to the connector brackets 22. Therefore, the attachment flanges 104 have a distance between them equal to the distance between the grooved slots 74 along one side edge 76 of the connector bracket 22. The pair of abutment flanges 102 extend vertically along the inside face 110 of the plate 100 inside of and parallel to the attachment flanges 104. The abutment flanges 102 have an L-shaped transverse cross section and abut against the side edge 76 of the locator bracket 22 when the side trim strip 30 is attached to the locator bracket 22. The plate 100 also includes a covering flange 140 along one vertical side edge and a V-shaped flange 142 along the other side edge. The covering flange 140 extends vertically along the side edge of the plate 100 and is angled inward in order to cover the corners of the post-simulating joint 24 when the side trim strip 30 is attached to the connecting bracket 22. The V-shaped flange 142 extends vertically along the other side edge of the plate 100 and includes a first portion 144 parallel to the plate 100 and a second portion 146 angled inward thereby defining a notch 149 between the first portion 144 and the second portion 146. As seen in FIGS. 6 and 7, the covering flange 140 is accepted into the notch 149 of the V-shaped flange 142 of an adjacent side trim portion 148 between the first portion 144 and the second portion 146 of the V-shaped flange 142 of the adjacent side trim portion 148, thereby covering a corner between the two side trim portions 94, 148 and the beveled corners 72 of the connector brackets 22.

In the illustrated example, the transition cap 96 includes a top section 114 aligned with the side trim portion 94 and an extending section 116 projecting from the top section 114. The top section 114 includes a plate 118 having a C-shaped bar 120 integral with and extending from the side edges and the top edge of the plate 118. The extending portion 116 extends from an inside face 122 of a top cross-bar 124 of the C-shaped bar 120. The extending portion 116 includes a panel 126 extending perpendicularly from the face 122 of the top cross bar 124 that includes two of the top tabs 38 extending from the panel 126 in a direction opposite to the top cross bar 124. The top tabs 38 include a pair of locking fingers 133 that extend towards each other from the end of each top tab 38, thereby defining two U-shaped channels 137 between the locking finger 133, the top tab 38 and the panel 126. As explained in more detail below, the locking fingers 133 help to connect the top cap 50 to the frame 12. The panel 126 also includes two pairs of downwardly depending walls 131 defining downwardly opening recesses 128 between each pair of walls 131. The recesses 128 have the same distance between them as the distance between the attachment flanges 104 of the side trim portion 94. As seen in FIG. 5, the top section 114 has a longer length than the panel 126 of the extending section 116, thereby defining an L-shaped joint 127 between the face 122 of the top cross bar 124 and a side edge 125 of the panel 126. The panel 126 also has beveled corners 129 distal the face 122 of the top cross bar 124. As explained in more detail below, the L-shaped joint 127 and the beveled corners 129 of the panel 126 help to connect the top cap 50 to the partition system 10.

The side trim portion 94 is attached to the transition cap 96 by sliding the top edge 98 of the side trim portion 94 upwardly into the transition cap 96 with an exterior surface 130 of the plate 100 of the side trim portion 94 mating with an interior surface of the plate 118 of the transition cap 96. As the side trim portion 94 is slid upward into the transition cap 96, the attachment flanges 104 will enter the recesses 128 and the barbs 112 on the attachment flanges 104 engage the walls 131 of the recess 128, thereby frictionally attaching the transition cap 96 to the side trim portion 94. Preferably, the transition cap 96 is mechanically secured to the side trim portion 94 by sonic welding, an adhesive or other fastener.

Figure 9:
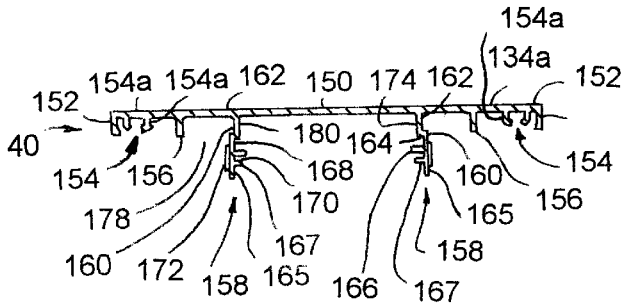
FIG. 9 is a side view of the top trim strip embodying the present invention.
Figure 8:
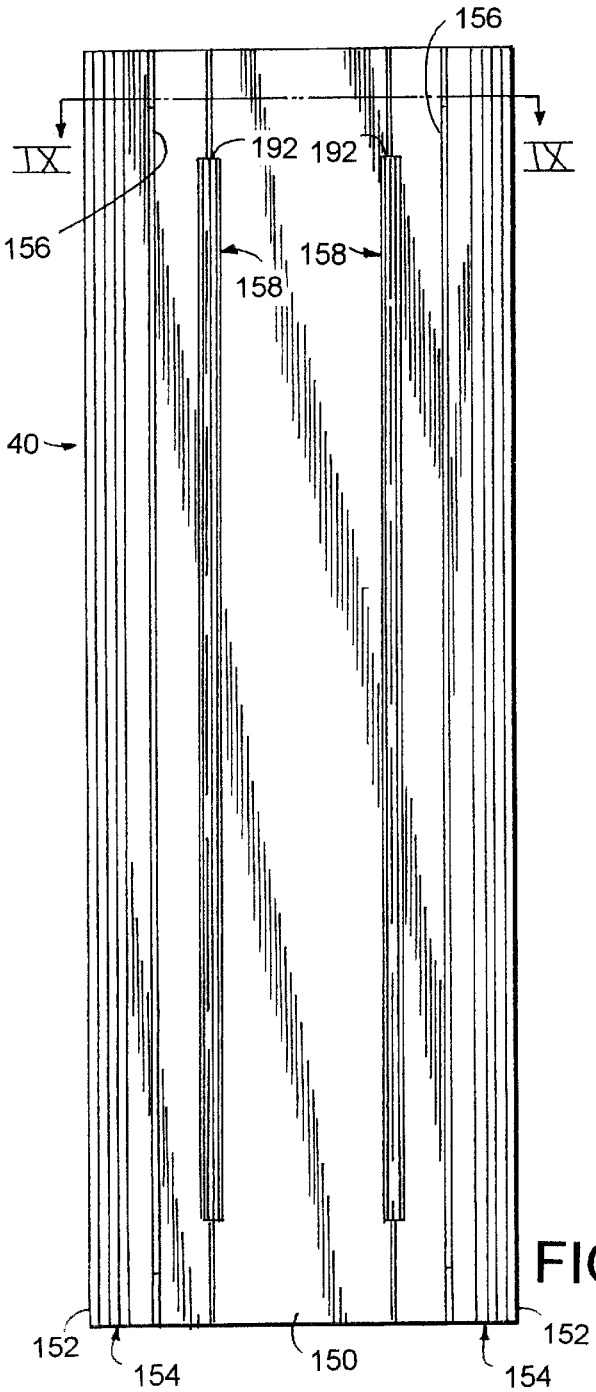
FIG. 8 is a bottom view of a top trim strip embodying the present invention.

The illustrated top trim strip 40 (FIGS. 8 and 9) connects to the associated open top 42 of the large width partition panels 12. The top trim strip 40 includes a plate 150 having a pair of end covering flanges 152, a pair of cover receiving flanges 154, a pair of first attachment flanges 156 and a pair of second attachment flanges 158. The pair of end covering flanges 152 extend perpendicularly along the length of the side edges of the plate 150. The pair of cover receiving flanges 154 each include two strips 155 biased towards each other extending from the plate 150 inside of the end covering flanges 152. The cover receiving flanges 154 are adapted to accept a covering plate (not shown) that covers the top of side faces of the panels 12. As seen in FIG. 9, the end covering flanges 152 will conceal the cover receiving flanges 154 from a line of sight perpendicular to the end covering flanges 152. The first attachment flanges 156 extend perpendicularly from the plate 150 inside of the cover receiving flanges 154. The second attachment flanges 158 include a pair of oppositely facing strips 160 that extend from the plate 150 inside of the first attachment flanges 156. The strips 160 include a first leg 162 extending perpendicularly from the plate 150, a second leg 164 extending outward perpendicularly from the first leg 162, and a third leg 165 extending perpendicularly from the second leg 164 and parallel to the first leg 162. The first leg 162 includes an inwardly protruding rib 174 used to connect the in-line connector 46 to the top trim strip 42. The third leg 165 includes a first inwardly extending arm 166 and a second inwardly extending arm 167, the arms 166–167 being parallel to the second leg 164. The arms 166–167 and the second leg 164 therefore define a first slot 168 between the second leg 164 and the first arm 166 and a second slot 170 between the first arm 166 and the second arm 167. The third legs 165 also include an outwardly facing protrusion 172 along the back face of the third leg 165. The top trim strip 42 is attached to the frame 12 by inserting two inverted U-shaped walls 176 (see FIG. 2) on the top of the frame 12 into a space 178 between the first 156 and second attachment flanges 158. The U-shaped walls 176 are frictionally held within the space 178 (with help from the protrusions 172) to connect the top trim strip 42 to the frame 12. As seen in FIG. 8, the second attachment flanges 158 do not extend along the entire length of the plate 150. As described in more detail below, a space 180 below the plate 150 and above the ribs 174 on the first leg 162 helps to connect the in-line connector 46 to the top trim strip 42.

Figure 10:
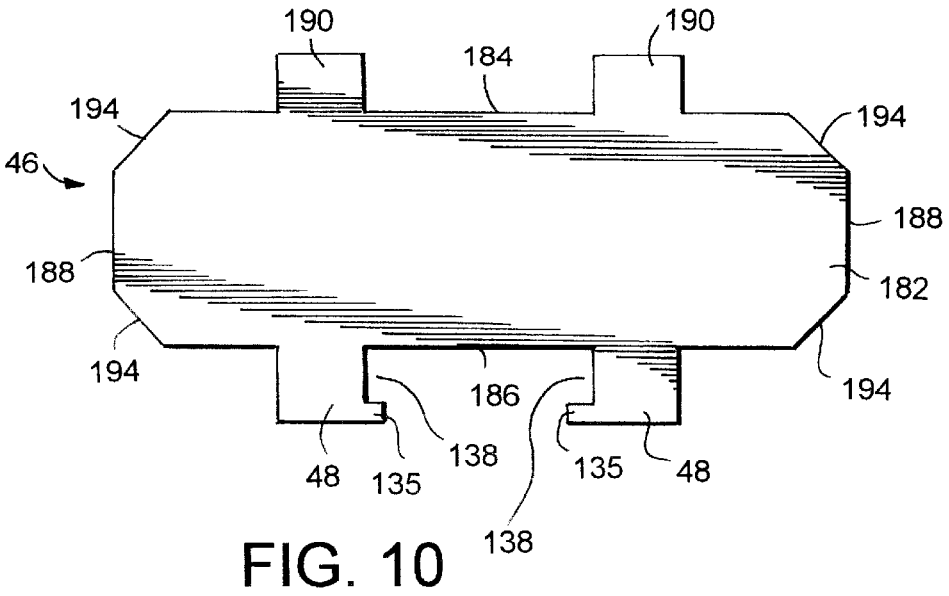
FIG. 10 is a top view of an in-line connector embodying the present invention.

In the illustrated example, in-line connector 46 (FIG. 10) includes a central plate 182 having a first end edge 184, a second end edge 186 and a pair of side edges 188. The first end edge 184 includes a pair of alignment tabs 190 extending outwardly co-planar with the central plate 182. The alignment tabs 190 assist in connecting the in-line connector 46 to the top trim strip 42. The second end edge 186 of the central plate 182 includes the inwardly protruding tabs 48 extending outwardly co-planar with the central plate 182.

The inwardly protruding tabs 48 include a pair of locking fingers 135 that extend towards each other from the end of each top tab 38, thereby defining channels 138 between the locking finger 135, the inwardly protruding tab 48 and the second end edge 186 of the panel 126. As explained in more detail below, the locking fingers 133 of the top tabs 38 of the side trim strip 30 and the locking fingers 135 of the inwardly protruding tabs 48 of the in-line connector 46 help to connect the top cap 50 to the frame 12. The in-line connector 46 also includes beveled corners 194 between each edge of the central plate 182. As explained in more detail below, the beveled corners 194 of the in-line connector 46 work with the L-shaped joint 127 and the beveled corners 129 of the transition cap 94 to help connect the top cap 50 to the partition system 10.

The illustrated in-line connector 46 is mated with the top trim strip 40 by sliding the first end edge 184 of the central plate 182 into the top trim strip 42 with the side edges 188 of the central plate 182 abutting the pair of first attachment flanges 156 and biasing the pair of first attachment flanges 156 outward until the first end edge 184 abuts against an end 192 of the pair of second attachment flanges 158 (see FIG. 8). As the in-line connector 46 is slid against the plate 150 in the top trim strip 42, the alignment tabs 190 are inserted between the plate 150 and the ribs 174 on the first leg 162 of the top trim strip 42. The in-line connector 46 is therefore connected to the top trim strip 42 by friction between the alignment tabs 190 and the pair of first attachment flanges 156 and the friction between the central plate 182 and the pair of second attachment flanges 158.

Figure 11:
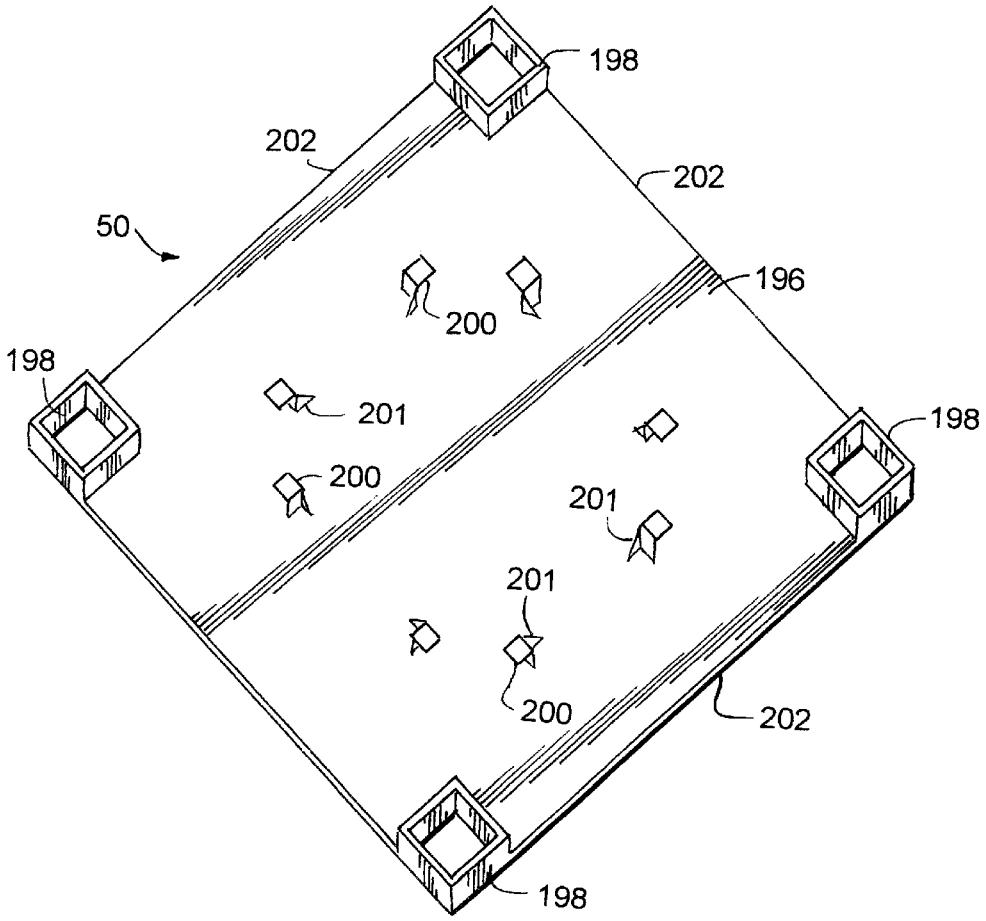
FIG. 11 is a bottom view of a top cap embodying the present invention.

In the illustrated example, the top cap 50 (FIG. 11) includes a substantially square panel 196 having a downward depending connector tab 198 at each corner of the square panel 196. The connector tabs 198 preferably have a substantially square configuration with side walls bowed outward. The illustrated top cap 50 also includes eight downwardly depending L-shaped snap-fit tabs 200. Two of the snap-fit tabs 200 are aligned parallel each side edge 202 of the square panel 196 a short distance inside of the connector tabs 198. Each snap-fit tab 200 preferably includes a truss 201 extending between the snap-fit tab 200 and the square panel 196. As explained in more detail below, the snap-fit tabs 200 mate with the locking fingers 133 of the top tabs 38 of the side trim strip 30 and the locking fingers 135 of the top tabs 48 of the in-line connector 46 help to secure the top cap 50 to side trim strips 30 and the in-line connectors 46.

The illustrated large intersection 16 of the partition system 10 having adjacent frame ends 20 interconnected by vertically spaced connector brackets 22 to define the post-simulating joint 24 is constructed by first placing the frame ends 20 adjacent each other. The T-shaped hook brackets 66 are then connected to several connector brackets 22 by fasteners 84, with the number of T-shaped hook brackets 66 for each connector bracket 22 being equal to the number of adjacent frame ends 20 in the large intersection 16. The hooks 90 of the T-shaped hook brackets 66 are then inserted into the openings 92 of the bottom plates 88 of the frame ends 20 and a fastener 86 is inserted into each T-shaped hook bracket 66 and into the bottom plates 88 of the frame ends 20 to secure the locator brackets to the frame ends 20, thereby interconnecting the frame ends 20. The locator bracket 28 is thereafter connected to the uppermost one of the connector brackets 22 by inserting fasteners 57 through the apertures 55 in the bottom platform 52 of the locator bracket and into the uppermost one of the connector brackets 22. The top trim strip 42 is then engaged with the in-line connector 46 and lowered into each associated open top of the panels 12 to provide a trim cover for the top of the panels 12. The in-line connectors 46 are configured such that the inwardly facing tabs 48 mate and abut the upper tabs 34 of the locator bracket 32.

The side trim strip 30 encloses the associated open side(s) of the post-simulating joint 24 by first overlapping the top tabs 38 of the side trim strip 30 with the top edges 60 of the outward extending upper tabs 34 of the locator bracket 28. The side trim strip 30 is then slid towards the post-simulating joint 24 until the attachment flanges 104 of the side trim strip 30 are aligned with the grooved slots 74 in the side edges 76 of the connector brackets 22. The attachment flanges 104 of the side trim strip 30 are then forced into the grooved slots 74 until the abutment flanges 102 of the side trim strip 30 abut against the side edge 76 of the connector bracket 22, wherein the barbs 112 of the attachment flanges 104 extend into the grooves 75 of the grooved slots 74 to hold the side trim strip 30 in place. The top tabs 38 of the side trim strip 30, when mating and abutting with outward extending upper tabs 34 of the locator bracket 28, assure that the side trim strip 30 is located in the proper vertical position. The proper vertical position of the side trim strip 30 ensures that the tops and bottom edges of the side trim strip 30 will align with other top and bottom edges of other side trim strips and the top and bottom edges of the frame 12 to provide a secure connection and an aesthetically pleasing appearance.

Figure 12:
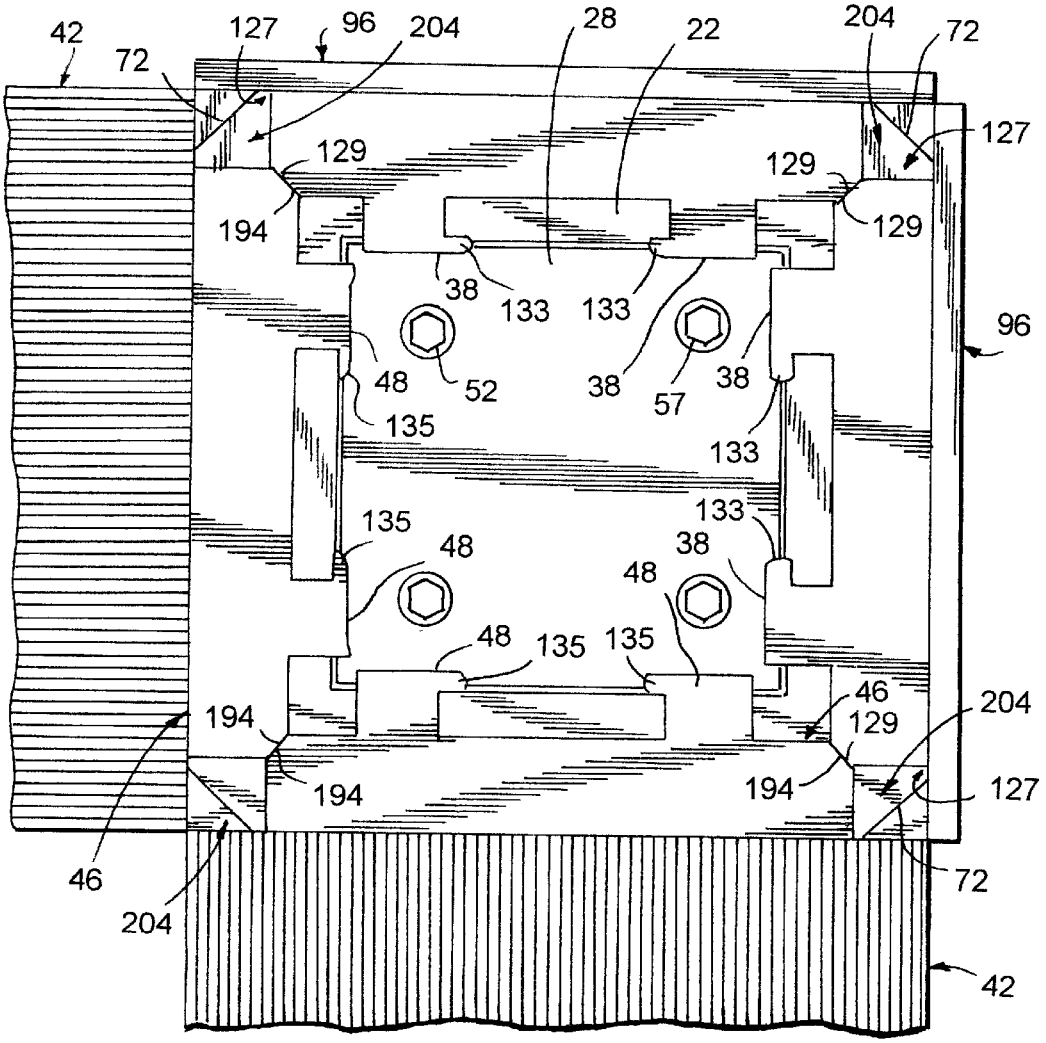
FIG. 12 is a top view of the top trim strip and side trim strip after joined to a post-simulating joint embodying the present invention.
Figure 13:
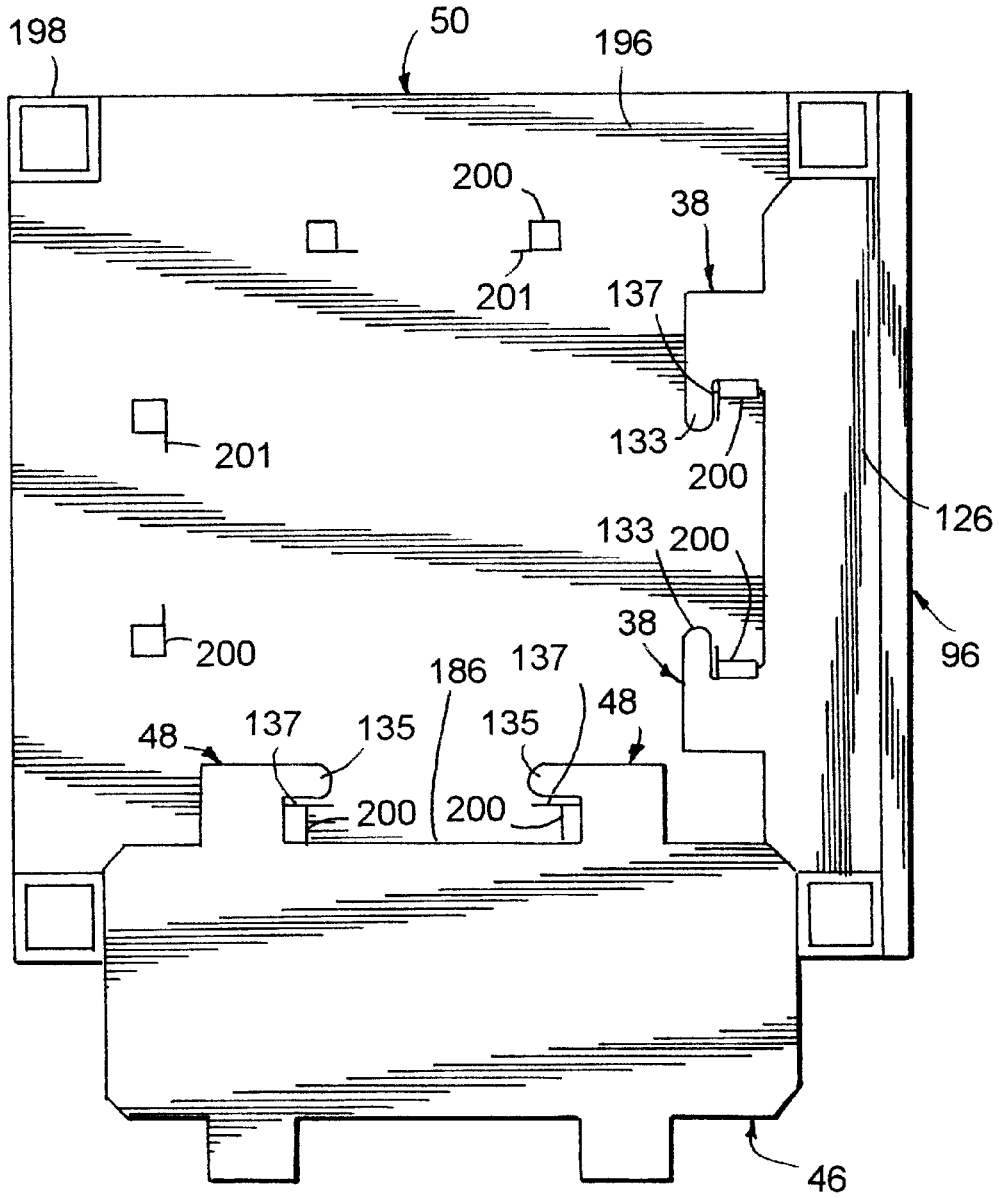
FIG. 13 is a bottom view of the top cap connected to a transition cap of the side trim strip and the in-line connector embodying the present invention.
Figure 14:
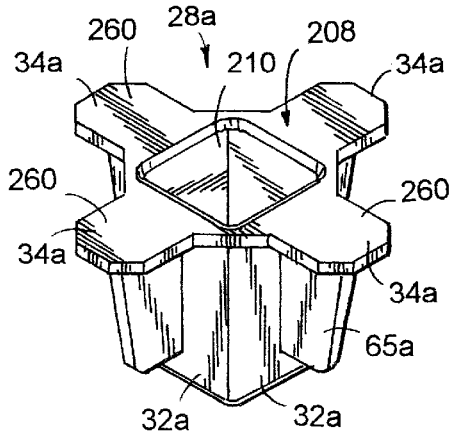
FIG. 14 is a perspective view of a locator bracket of a second embodiment of the present invention.
Figure 15:
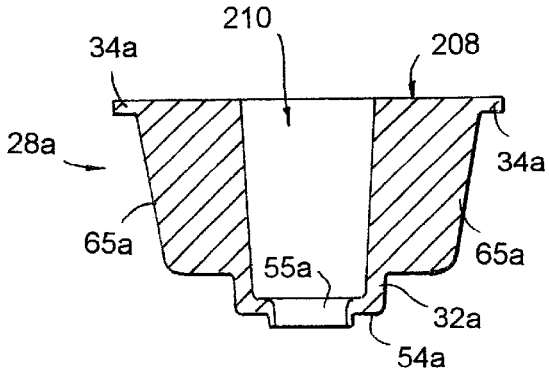
FIG. 15 is a cross sectional view of the locator bracket of the second embodiment of the present invention.
Figure 18:
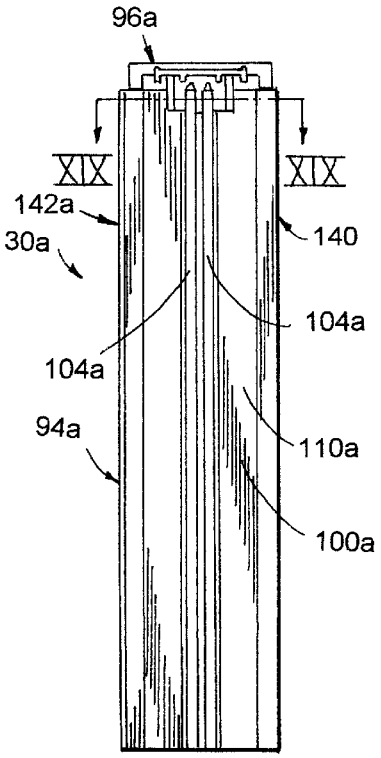
FIG. 18 is a side view of a side trim strip of the second embodiment of the present invention.
Figure 19:
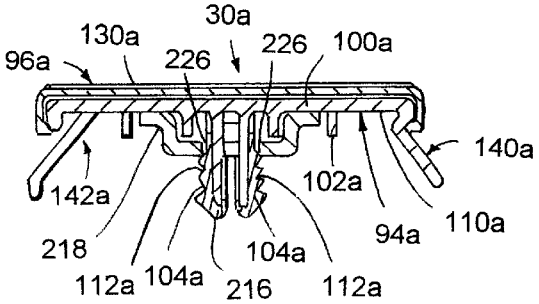
FIG. 19 is a cross-sectional view of the side trim strip the second embodiment of the present invention taken along the line XIX—XIX, FIG. 18.

As seen in FIG. 12, once the top trim strips 42 and the side trim strips 30 have been connected to the frames 12 or the locator brackets 22, respectively, the beveled corners 128 of the panel 126 of the extending section 116 of the transition cap 96 will abut adjacent beveled corners 194 of the central plate 182 of the in-line connector 46. Furthermore, adjacent beveled corners 194 of adjacent in-line connectors 46 and adjacent beveled corners 128 of adjacent transition caps 96 will abut each other. A square aperture 204 is thereby formed between the in-line connectors 46 and the transition caps 96 defined by the L-shaped joint 127 of the transition cap 96, the side edge 188 of the in-line connector 46 and an end edge 206 of the top trim strip 40. Square apertures 204 are also formed between two L-shaped joints 127 of adjacent transition caps 96 and two adjacent in-line connectors 46 with their associated top trim strips 40. The top cap 50 is connected to the post-simulating joint 24 by inserting the connector tabs 198 of the top cap 50 into the apertures 50, thereby abuttingly supporting the top cap 50 on the top tabs 38 of the side trim strip 30 and top tabs 48 of the in-line connectors 46 to positively locate the top cap 50. The top cap 50 will also rest on the abutment flanges 64 of the locator bracket 28. The connector tabs 198 preferably have bowed outer side walls to provide more friction between the top cap 50 and the associated parts of the transition cap 94 and the in-line connector 48 to better secure the top cap 50 in place. Furthermore, FIG. 14 shows a bottom view of the top cap 50 positively connected to one of the in-line connectors 46 and one of the transition caps 96. The top cap 50 is positively connected to the in-line connector 46 and the transition cap 96 because the snap-fit tabs 200 of the top cap will snap around the top tabs 38 of the transition cap 96 and the top tabs 48 of the in-line connector 46 when the top cap 50 is lowered upon the top tabs 38 of the transition cap 96 and the top tabs 48 of the in-line connector 46. Furthermore, the locking fingers 133 of the top tabs 38 of the transition cap 96 and locking finger 135 of the top tabs 48 of the in-line connector 46 retain the snap-fit tabs 200 in place in the channels 137 of the transition cap 96 and the channels 138 of the in-line connector 46.

FIGS. 14–24 are generally drawn to another embodiment of the present invention, having a second embodiment for the locator bracket 28*a* and associated elements for the small intersection 18 of the small partition panels 14. Since the small intersection 18 is similar to the previously described large intersection 16, similar parts appearing in FIGS. 2–13 and FIGS. 14–24, respectively, are represented by the same, corresponding reference number, except for the suffix "a" in the numerals of the latter.

In the illustrated example, the locator bracket 28*a* (FIGS. 14–17) is shaped to be attached to one of the connector brackets 22*a* and includes upstanding side walls 32*a* with outward extending upper tabs 34*a*. The locator bracket 28*a* includes an X-shaped top surface 208 defining the upper tabs 34*a*. The X-shaped top surface 208 includes a centrally located opening 210 with the upstanding side walls 32*a* tapering downwardly in a square configuration from the opening 210. A bottom platform 54*a* is connected to the bottom edges of the side walls 32*a* and includes a central aperture 55*a* for insertion of a fastener 57*a* (see FIG. 16) for attaching the locator bracket 28*a* to the uppermost connector bracket 22*a*. Each of the upper tabs 34*a* include a beam 65*a* extending from the bottom of the upper tab 34*a* in a direction substantially perpendicular to the upper tabs 34*a*. The beam 65*a* extends downward from the upper tab 34*a* is connected to an associated side wall 32*a*, thereby providing support for the upper tab 34*a*.

Figure 16:
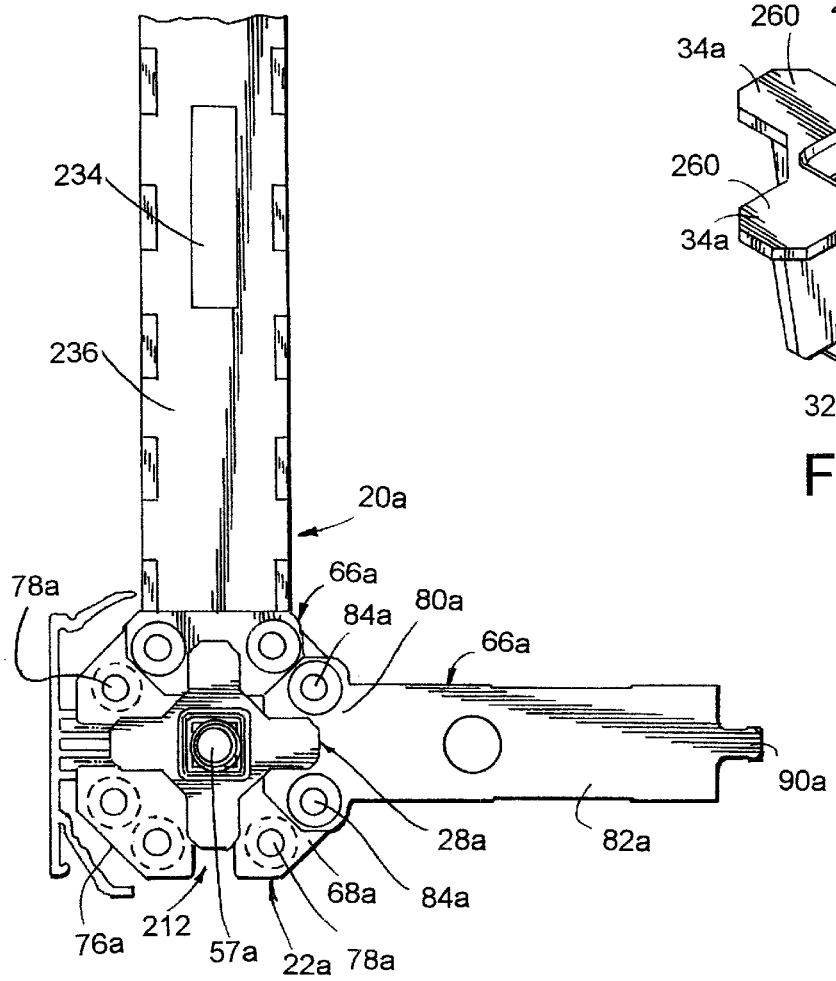
FIG. 16, is a top view of a frame end, a hook bracket, a connector bracket, the locator bracket and a side trim portion of the second embodiment of the present invention.
Figure 17:
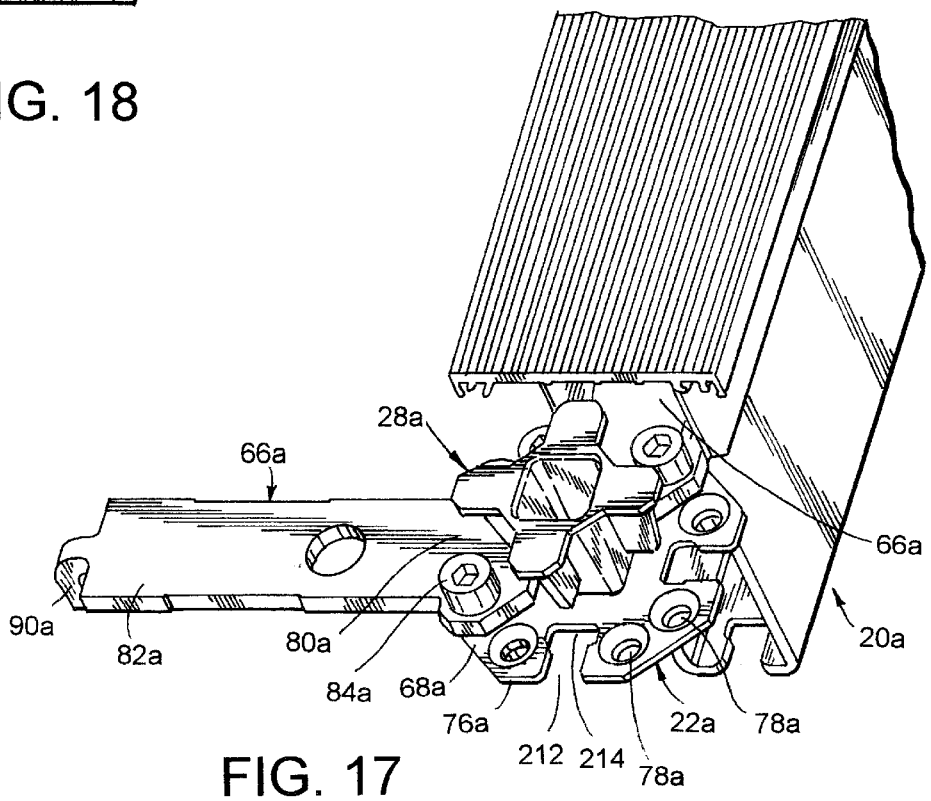
FIG. 17 is a top perspective view of the frame end, the top trim strip, the locator bracket, the connector bracket and a hook bracket of the second embodiment of the present invention.

As illustrated in FIGS. 16–17, the locator bracket 28*a* is attached to the uppermost one of the connector brackets 22*a*, and the connector brackets 22*a* are attached to the adjacent frame ends 20*a* by a T-shaped hook bracket 66*a*. The illustrated connector bracket 28*a* includes a substantially octagonal plate 68*a* having the locator bracket 28*a* attached to a top surface of the octagonal plate 68*a* by a fastener 57*a*. The octagonal plate 68*a* also includes a slot 212 with an enlarged bottom 214 in every other side edge 76*a* of the octagonal plate 68*a*. As explained in more detail below, slots 212 work similarly to the grooved slots 74 of the first embodiment of the locator bracket 28*a*. A pair of apertures 78*a* are located adjacent each side edge 76*a* of the octagonal plate 68*a* that does not include a slot 212. The apertures 78*a* preferably have a counter sunk perimeter. A pair of fasteners 84*a* extend through the top section 80*a* of the T-shaped hook bracket 66*a* and into the apertures 78*a* of the connector bracket 22*a* to attach the hook bracket 66*a* to the connector bracket 22*a*. A fastener (not shown) also extends through the leg 82*a* of the hook bracket 66*a* and into a middle plate (below the hook bracket 66*a* as seen in FIG. 17) of the frame end 20*a*, thereby securing the connector bracket 22*a* and the hook bracket 66*a* to the small width partition panel 14. A downward facing hook 90*a* of the T-shaped hook bracket 66*a* hooks into an opening (not shown) in the middle plate of the frame end 20*a* in the same manner as the connection of the T-shaped hook bracket 66 to the bottom plate 88 of the large width partition panel 12 in the first embodiment. It is noted that the T-shaped hook brackets 66*a* and the connector brackets 22*a* are the subject matter of commonly assigned U.S. Pat. No. 5,867,955, hereby incorporated by reference.

Figure 23:
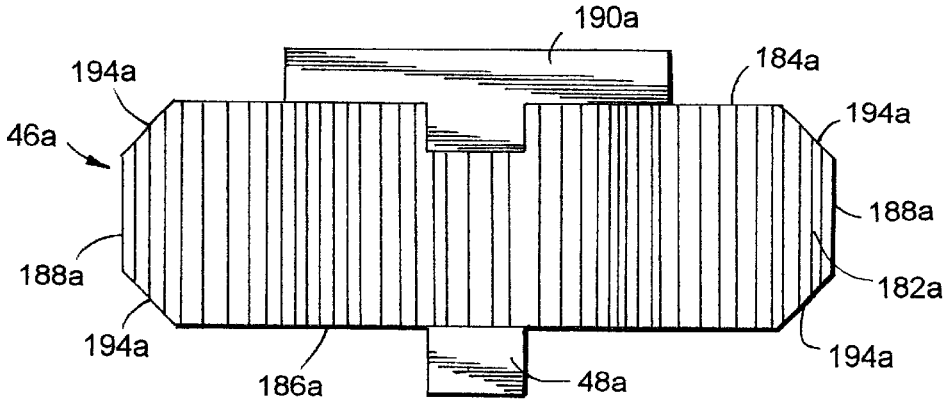
FIG. 23 is a top view of an in-line connector of the second embodiment of the present invention.

The illustrated side trim strip 30*a* (FIGS. 18–20) includes an extended side trim portion 94*a* shaped to enclose the associated open side 36*a* of the post-simulating joint 24*a* and a top transition cap 96*a* attached to a top edge 98*a* of the side trim portion 94*a*. The side trim portion 94*a* includes a substantially planar plate 100*a* having a pair of centrally located attachment flanges 104*a* and a pair of abutment flanges 102*a*. The pair of attachment flanges 104*a* extend vertically along an inside surface 110*a* of the plate 100*a*. The attachment flanges 104*a* include outwardly extending barbs 112*a* and an enlarged barbed end 216 projecting from the outside face of each of the attachment flanges 104*a*. As seen in FIGS. 16 and 23, the barbs 112*a* and the enlarged barb end 216 connect the side trim portion 94*a* to the connector brackets 22*a* by inserting the attachment flanges 104*a* into the slots 212 in each side edge 76*a* of the octagonal plate 68*a* of the connector brackets 22*a*. The barbs 112*a* project against the side edges of the slot 212 and the enlarged barb end 216 extends into the enlarged bottom 214 of the slot 212 to frictionally secure the side trim portion 94*a* to the connector brackets 22*a*. The pair of abutment flanges 102*a* extend vertically along the inside face 110*a* of the plate 100*a* outside of and parallel to the attachment flanges 104*a*. The abutment flanges 102*a* abut against the side edge 76*a* of the locator bracket 22*a* when the side trim strip. 30*a* is attached to the locator bracket 22*a*. The plate 100*a* also includes a covering flange 140*a* along one vertical side edge and a V-shaped flange 142*a* along the other side edge. The covering flange 140*a* and the V-shaped flange 142*a* have the same structure and function similarly to the covering flange 140 and the V-shaped flanges 142 of the first embodiment of the side trim strip 30.

Figure 20:
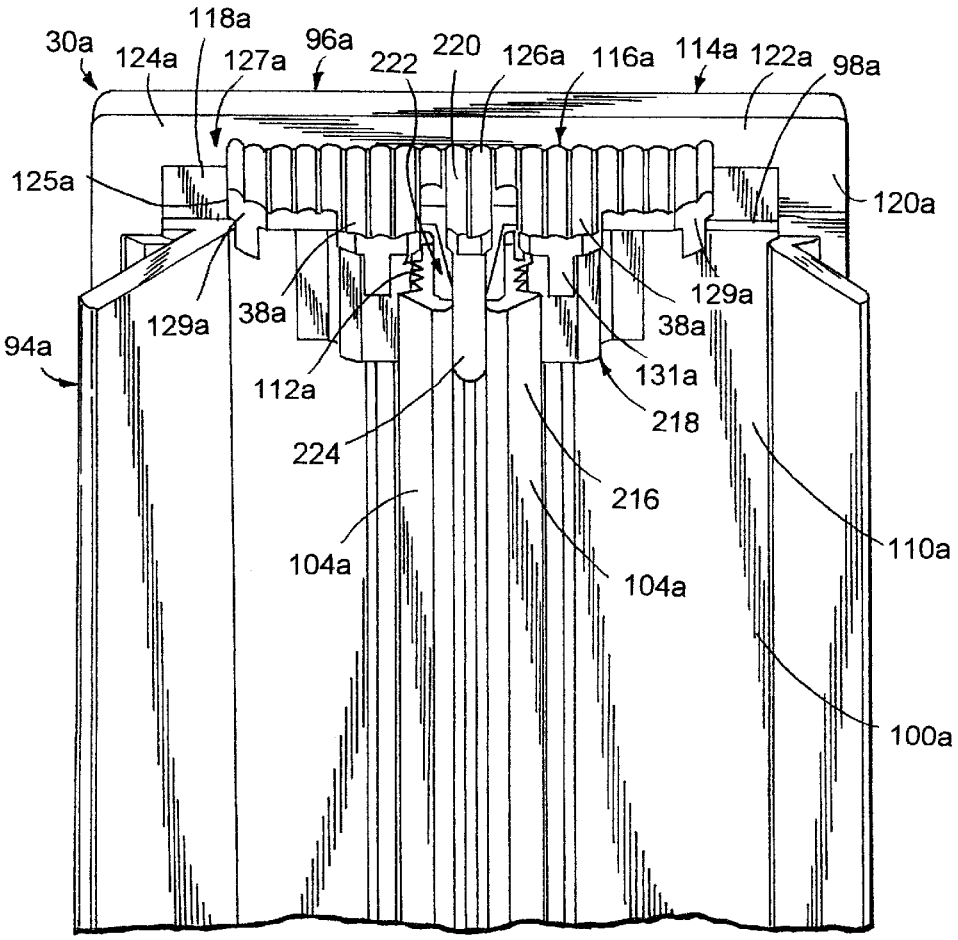
FIG. 20 is a top perspective view of the side trim strip of the second embodiment of the present invention.
Figure 21:
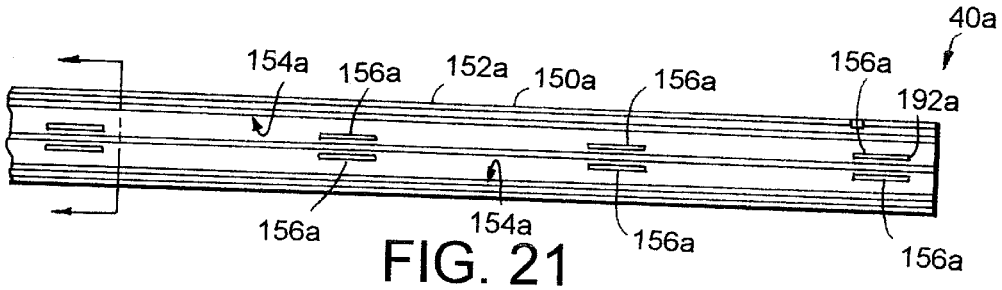
FIG. 21 is a bottom view of the top trim strip of the second embodiment of the present invention.
Figure 22:
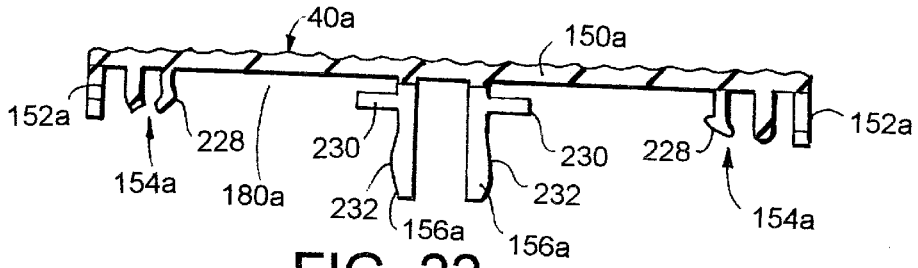
FIG. 22 is a cross-sectional view of the top trim strip of the second embodiment of the present invention taken along the line XXII—XXII, FIG. 21.

In the illustrated example, the transition cap 96*a* includes a top section 114*a* aligned with the side trim portion 94*a*, an extending section 116*a* projecting from the top section 114*a* and a connection plate 218 for securing the side trim portion 94*a* to the transition cap 96*a*. The top section 114*a* includes a plate 118*a* having a substantially C-shaped bar 120*a* integral with and extending from the side edges and the top edge of the plate 118*a*. The extending portion 116*a* extends from an inside face 122*a* of a top cross-bar 124*a* of the C-shaped bar 120*a*. The extending portion 116*a* includes a panel 126*a* extending perpendicularly from the face 122*a* of the top cross bar 124*a* that includes two of the top tabs 38*a* extending from the panel 126*a* in a direction opposite to the top cross bar 124*a*. Each top tab 38*a* includes a downwardly depending wall 131*a* defining a downwardly opening recess 222 therebetween. The recess 222 has width equal to the width of the upper tab 34*a* of the locator bracket 28*a*. The extending portion 116*a* also includes a centrally located top tab 220 extending from the panel 126 between the two top tabs 38*a*. The centrally located top tab 220 includes a downwardly depending wedge 224 used to connect the transition cap 96*a* to the side trim portion 94*a*. As seen in FIG. 20, the top section 114*a* has a longer length than the panel 126*a* of the extending section 116*a*, thereby defining an L-shaped joint 127*a* between the face 122*a* of the top cross bar 124*a* and a side edge 125*a* of the panel 126*a*. The panel 126*a* also has beveled corners 129*a* distal the face 122*a* of the top cross bar 124*a*. The L-shaped joint 127*a* and the beveled corners 129*a* of the panel 126*a* help to connect the top cap 50*a* to the partition system 10*a*. The connection plate 218 has a substantially C-shaped configuration and is connected to the plate 118*a* below the extending section 116*a*. The connection plate 218 includes a pair of downwardly opening slots 226 for connecting the transition cap 96*a* to the side trim portion 94*a*.

The illustrated side trim portion 94*a* is attached to the transition cap 96*a* by sliding the top edge 98*a* of the side trim portion 94*a* upwardly into the transition cap 96*a* with an exterior surface 130*a* of the plate 100*a* of the side trim portion 94*a* mating with an interior surface of the plate 118*a* of the transition cap 96*a*. As the side trim portion 94*a* is slid upward into the transition cap 96*a*, the attachment flanges 104 will enter the slots 226 of the connection plate 218 and the connection plate 218 will overlap the abutment flanges 102*a*. Furthermore, the wedge 224 of the centrally located top tab 220 is wedged between the attachment flanges 104*a*, thereby frictionally attaching the transition cap 96*a* to the side trim portion 94*a*. Preferably, the transition cap 96*a* is mechanically secured to the side trim portion 94*a* by sonic welding, an adhesive or other fastener.

The illustrated top trim strip 40*a* (FIGS. 21–22) connects to the associated open top 42*a* of the small width partition panels 14. The top trim strip 40*a* includes a plate 150*a* having a pair of end covering flanges 152*a*, a pair of cover receiving flanges 154*a* and interrupted pairs of attachment flanges 156*a*. The pair of end covering flanges 152*a* and the cover receiving flanges 154*a* have the same structure and function similarly to the pair of end covering flanges 152*a* and the cover receiving flanges 154*a* of the first embodiment of the top trim strip 40. The inside strip 155*a* of the pair of cover receiving flanges 154*a* each include a rib 228 for connecting the in-line connector 46*a* to the top trim strip 40*a*. The attachment flanges 156*a* extend perpendicularly from the plate 150*a* at interrupted points along the plate 150*a*. The attachment flanges 146*a* each include an abutment protuberance 230 between the outside face of the attachment flanges and the plate 150*a* and enlarged tips 232. The top trim strip 42*a* is attached to the frame 12*a* by the attachment flanges 146*a* into openings 234 along the top plate 236 (see FIG. 16) of the frames 12*a* until the abutment protuberances 230 abut against the top plate 236. The attachment flanges 146 are frictionally held within the openings 234 (with help from the enlarged tips 232) to connect the top trim strip 42*a* to the frame 12*a*. A space 180*a* below the plate 150*a* and above the ribs 228 on the cover receiving flanges 154*a* helps to connect the in-line connector 46*a* to the top trim strip 42*a*.

In the illustrated example, in-line connector 46*a* (FIG. 10) includes a central plate 182*a* having a first end edge 184*a*, a second end edge 186*a* and a pair of side edges 188*a*. The first end edge 184*a* includes an alignment tab 190*a* extending outwardly co-planar with the central plate 182*a*. The alignment tab 190*a* assists in connecting the in-line connector 46*a* to the top trim strip 42*a*. The second end edge 186*a* of the central plate 182*a* includes an inwardly protruding tab 48*a* extending outwardly co-planar with the central plate 182*a*. The in-line connector 46*a* also includes beveled corners 194*a* between each edge of the central plate 182*a*. The beveled corners 194*a* of the in-line connector 46*a* work with the L-shaped joint 127*a* and the beveled corners 129*a* of the transition cap 94*a* to help connect the top cap 50*a* to the partition system 10*a*.

The illustrated in-line connector 46*a* is mated with the top trim strip 40*a* by sliding the first end edge 184*a* of the central plate 182*a* into the top trim strip 42*a* with the side edges 188*a* of the central plate 182*a* abutting the inside strip 155*a* of the cover receiving flanges 154*a* and biasing the cover receiving flanges 154*a* outward until the first end edge 184*a* abuts against an end 192*a* (See FIG. 21) of the attachment flanges 156*a*. The in-line connector 46 is therefore connected to the top trim strip 42 by the friction between the central plate 182*a* and the inside strips 155*a* of the cover receiving flanges 154*a*.

Figure 24:
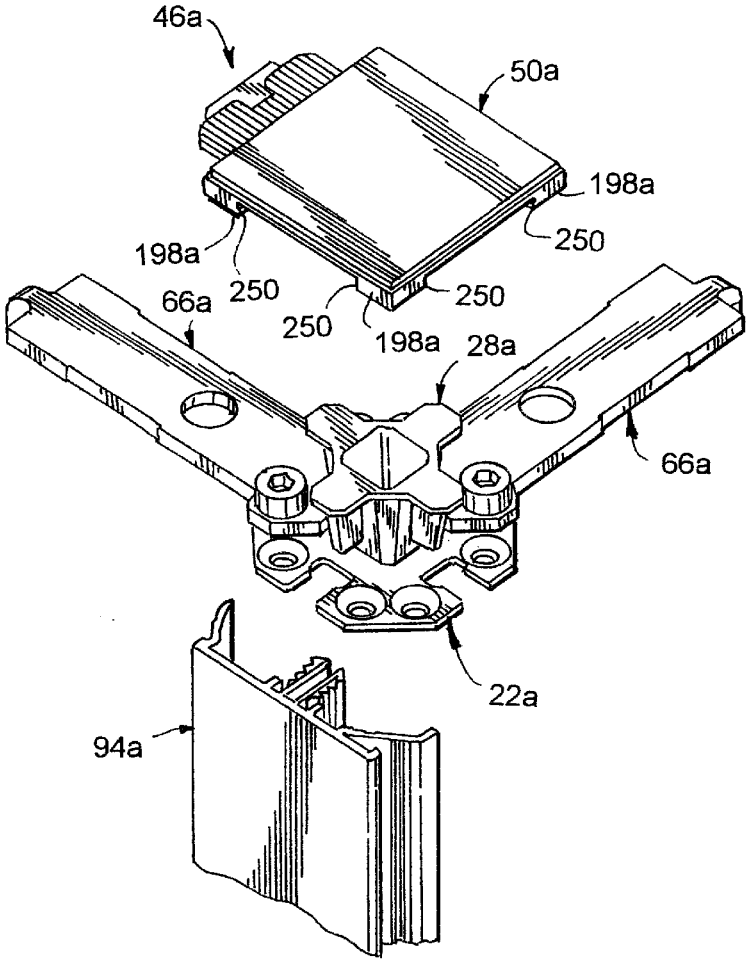
FIG. 24 is an exploded view of the top cap, the connector bracket, the locator bracket, the hook bracket and the side trim portion of the second embodiment of the present invention.
Figure 25:
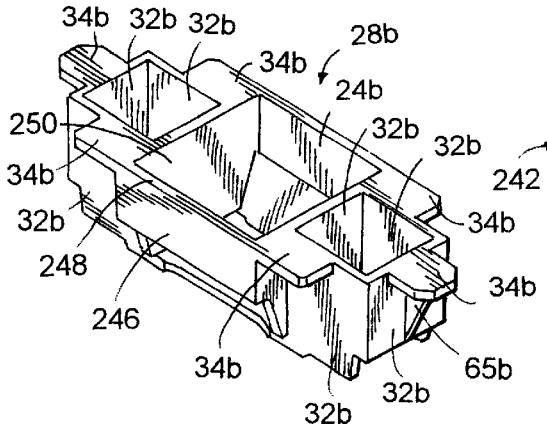
FIG. 25 is a perspective view of a locator bracket of a third embodiment of the present invention.

In the illustrated example, the top cap 50*a* (FIG. 11) is substantially similar to the top cap 50 of the first embodiment except that the top cap 50*a* does not include the tabs 200. Furthermore, as seen in FIG. 24, connector tabs 198*a* of the top cap 50*a* preferably include a rim 250 extending along the inner two sides of the connector tabs 198 to help connect the top cap 50 to the post-simulating joint 24*a*.

The illustrated small intersection 18 of the partition system 10 having adjacent frame ends 20*a* interconnected by vertically spaced connector brackets 22*a* to define the post-simulating joint 24*a* is constructed in the same manner as the connection of the large intersection 16. Furthermore, the side trim strip 30*a* encloses the associated open side(s) of the post-simulating joint 24*a* by first overlapping the top tabs 38*a* of the side trim strip 30*a* with a top face 260 (See FIG. 14) of the outward extending upper tab 34*a* of the locator bracket 28*a*. The side trim strip 30*a* is then slid towards the post-simulating joint 24*a* until the attachment flanges 104*a* of the side trim strip 30*a* are aligned with the slots 212 in the side edges 76*a* of the connector brackets 22*a*. Furthermore, the upper tab 34*a* of the locator bracket 28*a* will extend into the recess 222 to locate the upper tab 34*a* in the correct position relative to the side trim strip 30*a*. The attachment flanges 104*a* of the side trim strip 30*a* are then forced into the slots 212 until the abutment flanges 102*a* of the side trim strip 30*a* abut against the side edges 76*a* of the connector brackets 22*a*, wherein the barbs 112*a* of the attachment flanges 104*a* abut against the side walls of the slots 212 and the enlarged barb end 216 extends into the enlarged bottoms 214 of the slots 212 to hold the side trim strip 30*a* in place. The top tabs 38*a*, 220 of the side trim strip 30*a*, when mating and abutting the outward extending upper tab 34*a* of the locator bracket 28*a*, assure that the side trim strip 30*a* is located in the proper vertical position. The proper vertical position of the side trim strip 30*a* ensures that the tops and bottom edges of the side trim strip 30*a* will align with other top and bottom edges of other side trim strips and the top and bottom edges of the frame 12*a* to provide a secure connection and an aesthetically pleasing appearance. Furthermore, the top trim strips 40*a* and the side trim strips 30*a* form square apertures 204*a* for the top caps 50*a* similar to the square apertures 204 for the top cap 50 in the first embodiment.

FIGS. 25–29 are generally drawn to another embodiment of the present invention, having a third embodiment for the locator bracket 28*b* for the medium intersection 17 of one of the large partition panels 12 and one of the small partition panels 14. Since the medium intersection 17 is similar to the previously described large intersection 16 and small intersection 18, similar parts appearing in FIGS. 2–13 and FIGS. 25–29, respectively, are represented by the same, corresponding reference number, except for the suffix "b" in the numerals of the latter. The conjunction of the medium intersection 17 and the large partition panel 12 includes all of the elements as described above in the first embodiment. Furthermore, the side trim panel 30 opposite the large partition panel 12 includes the elements described above in the first embodiment. Likewise, the conjunction of the medium intersection 17 and the small partition panel 14 includes all of the elements as described above in the second embodiment. Moreover, the side trim panel 30*a* opposite the small partition panel 14 includes the elements described above in the second embodiment. The only new elements for the illustrated third embodiment include the locator bracket 28*b* and the connector bracket 22*b*. Furthermore, the illustrated third embodiment includes a top cap that is similar to the top cap 50*a* of the second embodiment, except that the top cap for the third embodiment is rectangular instead of square.

Figure 26:
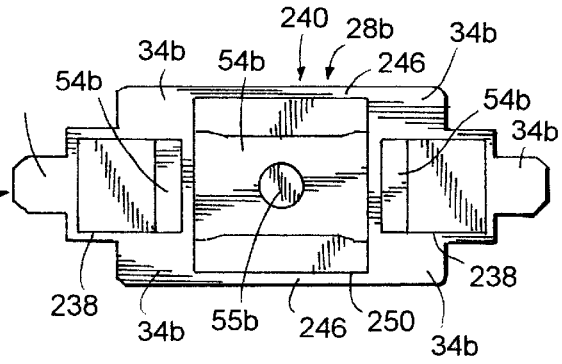
FIG. 26 is a top view of the locator bracket of the third embodiment of the present invention.
Figure 27:
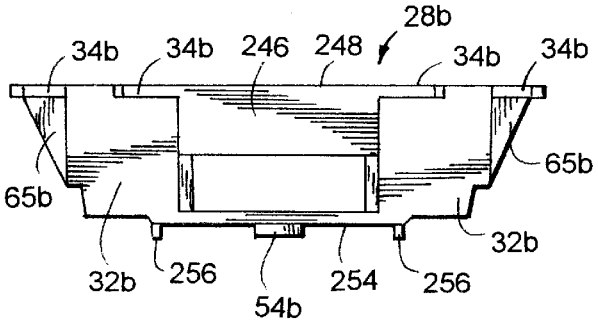
FIG. 27 is a side view of the locator bracket of the third embodiment of the present invention.
Figure 28:
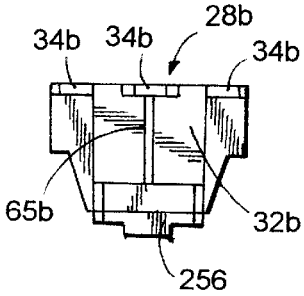
FIG. 28 is an end view of the locator bracket of the third embodiment of the present invention.
Figure 29:
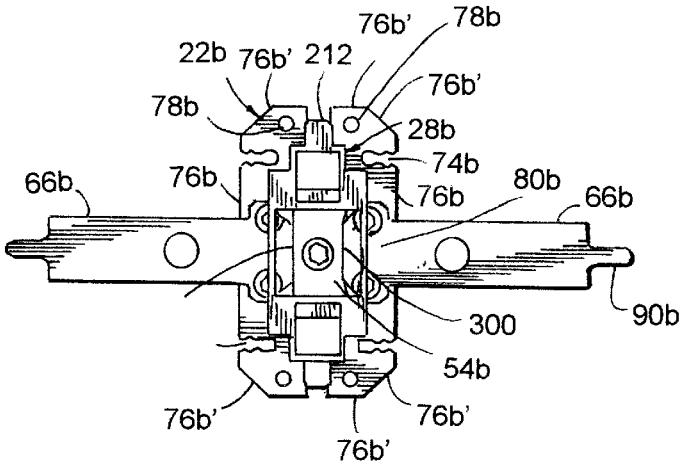
FIG. 29 is a top view of the locator bracket, the hook brackets and the connector brackets of tie third embodiment of the present invention.

In the illustrated example, the locator bracket 28*b* (FIGS. 25–29) is shaped to be attached to one of the connector brackets 22*b* and includes upstanding side walls 32*b* with outward extending upper tabs 34*b*. The locator bracket 28*b* includes a bottom platform 54*b* having a substantially rectangular configuration thereby defining a long side 240 of the locator bracket 28*b* and a short side 242 of the locator bracket 28*b*. The side walls 32*b* of the locator bracket 28*b* include two boxes 238 having a substantially square configuration extending upwards from each side of the bottom platform 54*b*. The boxes 238 therefore have the bottom of one sidewall 32*b* and portions of two opposite side walls 32*b* of the boxes connected to the bottom platform 54*b*. One upper tab 34*b* extends from the side wall 32*b* of the short side 242 of the locator bracket 28*b*. The upper tabs 34*b* of the short side 242 therefore extend from opposite sides of the locator bracket 28*b* from the side wall 32*b* of each box 238 that is not connected to the bottom platform 54*b*. Each of the upper tabs 34*b* include a beam 65*b* extending from the bottom of the upper tab 34*b* in a direction substantially perpendicular to the upper tabs 34*b*. The beam 65*b* extends downward from the upper tab 34*b* and is connected to an associated side wall 32*b* of the box 238 opposite the bottom platform 54*b*, thereby providing support for the upper tab 34*b*. Likewise, two of the upper tabs 34*b* extend from the long side 240 of the locator bracket 28*b*. The two upper tabs 34*b* on each long side 240 of the locator bracket 28*b* extend from opposite side walls 32*b* of each box 238 adjacent the side wall 32*b* totally connected to the bottom platform 54*b*. The side wall 32*b* totally connected to the bottom platform 54*b* also extends outward and is attached to the bottom face of the associated upper tab 34*b*. Moreover, a connection flange 246 connects the outside edge of each upper tab 34*b* thereby creating a top surface 248 for the locator bracket 28*b* having a large square opening 250 and two smaller square openings 252 connected to opposite sides of the large square opening 250. As seen in FIGS. 26–28, the bottom platform 54*b* includes a central hole 55*b* with a downward boss 254 and two engagement flanges 256 extending from opposite short sides of the bottom platform 54*b* for connecting the locator bracket 28*b* to the connector bracket 22*b*.

The illustrated connector bracket 22*b* (FIG. 29) is a combination of the connector bracket 28 of the first embodiment and the connector bracket 22*a* of the second embodiment. The connector bracket 22*b* has a generally rectangular configuration with two side edges 76*b* having grooved slots 74*b* for connection to the large partition panel 12 or the side trim panel of the first embodiment. The connector bracket 22*b* also has side edges 76*b*' similar to three of the side edges of the connector bracket 22*a* of the second embodiment. The side edges 76*b*' include three edges with a slot 212*b* having a large bottom 214*b* in the middle edge and an aperture 78*b* adjacent the two end edges of the side edges 76*b*'. The side edges 76*b*' are for connection to the small partition panel 14 as in the second embodiment or the side trim strip 30*a* as in the second embodiment. In order to allow the locator bracket 28*b* to fit between the two hook brackets 66*b* connected to the large width partition panels 12, the bottom platform 54*b* of the locator bracket 28*b* includes recessed longitudinal side walls 300 that allow the top portions 80*b* of the two hook brackets 66*b* to abut the locator bracket 28*b* and to connect to the connector bracket 22*b* without changing the configuration of the hook brackets 66*b* from the hook brackets of the first and second embodiments of the present invention. It is noted that the T-shaped hook brackets 66*b* and the connector brackets 22*b* are the subject matter of commonly assigned U.S. Pat. No. 5,867,955, hereby incorporated by reference.

Although the above embodiments are shown as including partition panels intersecting in an L-shaped configuration, the partition panels could intersect in a straight line (for adding off-line partition panels at a later time), in a T-shaped intersection, in an X-shaped intersection or any other intersection.

The above description is considered that of the preferred embodiments only. Modification of the invention will occur to those skilled in the art and to those who make or use the invention. For example, it is contemplated that the top cap of the second and third embodiments could include snap-fit tabs similar to the snap-fit tabs on the top cap of the first embodiment. Furthermore, it is contemplated that the transition cap and the in-line connectors of the second and third embodiments could include fingers similar to the fingers on the transition cap and the in-line connector of the first embodiment for connecting the top cap to the in-line connectors and the transition caps. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A partition for spatially dividing open building space, comprising:

a plurality of frames having adjacent frame ends interconnected by vertically spaced connector brackets to define a post-simulating joint; and a trim system for the plurality of frames including:

a locator bracket shaped to be attached to one of said connector brackets, and including upstanding side walls with outward extending upper tabs;

a side trim strip shaped to enclose an associated open side of the post-simulating joint and including at least one inwardly protruding top tab, each said top tab mating and abutting at least one of said upper tabs of said locator bracket to positively locate said side trim strip with respect to the adjacent frame ends.

2. The partition as set forth in claim 1, including:

a top cap shaped to enclose a top portion of the post-simulating joint, and being abuttingly supported on said at least one top tab of said side trim strip to positively locate said top cap.

3. The partition as set forth in claim 2, wherein:

said side trim strip includes a plurality of side trim strips.

4. The partition as set forth in claim 3, wherein:

said plurality of side trim strips define a plurality of apertures;

said top cap includes a plurality of downward depending connector tabs; and said plurality of downward depending connector tabs are closely received within said plurality of apertures to connect said top cap to said plurality of side trim strips.

5. The partition as set forth in claim 4, wherein:

said plurality of downward depending connector tabs and said plurality of apertures have square configurations.

6. The partition as set forth in claim 2, wherein:

said top cap includes a plurality of downwardly depending snap-fit tabs and each said at least one top tab includes fingers whereby said fingers are configured to engage said snap-fit tabs when said top cap is supported on said at least one top tab to mechanically secure said side trim strip to said top cap.

7. The partition as set forth in claim 2, wherein:

said trim system further includes:

at least one top trim strip shaped to enclose an associated open top of the panels; and an in-line connector engaged with said top trim strip and including at least one inwardly facing tab, each said inwardly facing tab mating and abutting at least one of said upper tabs of said locator bracket.

8. The partition as set forth in claim 7, wherein:

said side trim strip and said at least one top trim strip define a plurality of apertures;

said top cap includes a plurality of downward depending connector tabs; and said plurality of downward depending connector tabs are closely received within said plurality of apertures to connect said top cap to said side trim strip.

9. The partition as set forth in claim 1, wherein:

said side trim strip includes an extended substantially planar side trim portion shaped to enclose the associated open side of the post-simulating joint and a transition cap attached to a top edge of said side trim portion;

wherein said transition cap includes said at least one top tab.

10. The partition as set forth in claim 9, wherein:

said transition cap of said side trim strip includes a top section aligned with said side trim portion and an extending section including said at least one top tab, the extending section having a shorter length than said top section, and the apertures are defined by a side edge of the extending section and a face of said top section.

11. The partition as set forth in claim 1, wherein:

said locator bracket includes at least one hole configured to accept a fastener for attaching the locator bracket to the connector bracket.

12. The partition as set forth in claim 1, wherein:

said side trim strip includes at least one attachment flange adapted to connect said side trim strip to the connector brackets.

13. The partition as set forth in claim 1, wherein:

said connected bracket attached to said locator brackets is an uppermost one of said connector brackets.

14. A partition for spatially dividing open building space, comprising:

a plurality of partition panels having adjacent frame ends;

a plurality of connector brackets located at separate discrete locations, each connector bracket interconnecting adjacent ones of said frame ends to define a post-simulating joint;

a vertically elongated trim piece connected to said connector brackets and including an outwardly projecting tab; and a vertically registering bracket located within said post-simulating joint;

wherein said tab of said trim piece is adapted to vertically overlap a portion of said vertically registering bracket to positively vertically align said trim piece with respect to said adjacent frame ends.

15. The partition as set forth in claim 14, including:

a top cap shaped to enclose a top portion of the post-simulating joint, and being abuttingly supported on said outwardly projecting tab of said trim piece to positively locate said top cap.

16. The partition as set forth in claim 15, wherein:

said trim piece includes a plurality of trim pieces.

17. The partition as set forth in claim 16, wherein:

said plurality of trim pieces define a plurality of apertures;

said top cap includes a plurality of downward depending connector tabs; and said plurality of downward depending connector tabs are closely received within said plurality of apertures to connect said top cap to said side trim pieces.

18. The partition as set forth in claim 17, wherein:

said plurality of downward depending connector tabs and said plurality of apertures have square configurations.

19. The partition as set forth in claim 15, wherein:

said top cap includes a plurality of downwardly depending snap-fit tabs and each said outwardly projecting tab includes fingers whereby said fingers are configured to engage said snap-fit tabs when said top cap is supported on said outwardly projecting tab to mechanically secure said trim piece to said top cap.

20. The partition as set forth in claim 15, wherein:

said trim system further includes:

at least one top trim strip shaped to enclose an associated open top of the panels; and an in-line connector engaged with said trim piece and including at least one inwardly facing tab, each said inwardly facing tab mating and abutting said portion of said vertically registering bracket.

21. The partition as set forth in claim 20, wherein:

said trim piece and said at least one top trim strip define a plurality of apertures;

said top cap includes a plurality of downward depending connector tabs; and said plurality of downward depending connector tabs are closely received within said plurality of apertures to connect said top cap to said trim piece.

22. The partition as set forth in claim 14, wherein:

said trim piece includes an extended substantially planar side trim portion shaped to enclose the associated open side of the post-simulating joint and a transition cap attached to a top edge of said side trim portion;

wherein said transition cap includes said at least one top tab.

23. The partition as set forth in claim 22, wherein:

said transition cap of said trim piece including a top section aligned with said side trim portion and an extending section including said at least one top tab, the extending section having a shorter length than said top section, and the apertures are defined by a side edge of the extending section and a face of said top section.

24. The partition as set forth in claim 14, wherein:

said vertically registering bracket includes at least one hole configured to accept a fastener for attaching the vertically registering bracket to the connector bracket.

25. The partition as set forth in claim 14, wherein:

said trim piece includes at least one attachment flange adapted to connect said trim piece to the connector brackets.

26. The partition as set forth in claim 14, wherein:

said vertically registering bracket is attached to an uppermost one of said connector brackets.

27. The partition as set forth in claim 14, wherein:

said post-simulating joint includes vertically spaced open areas defined by said connector brackets.

28. A method of joining at least one side trim piece to a plurality of partition panels having adjacent frame ends comprising:

interconnecting the frame ends of the partition panels at separate discrete locations with at least one connector bracket to thereby define a post-simulating joint;

registering the at least one side trim piece at a proper vertical location by vertically overlapping a tab of the at least one side trim piece with a portion of a vertically registering bracket located within the post-simulating joint; and securing the at least one side trim piece to the connector bracket.

29. The method of joining at least one side trim piece to a plurality of partition panels having adjacent frame ends as set forth in claim 28, including:

enclosing a top portion of the post-simulating joint with a top cap; and abuttingly supporting the top cap on the tab of the at least one side trim piece to positively locate the top cap.

30. The method of joining at least one side trim piece to a plurality of partition panels having adjacent frame ends as set forth in claim 29, further including:

engaging snap-fit tabs that depend downward from the top cap with fingers of the tab of the at least one side trim piece when said top cap is supported on said tab of the at least one side trim piece to mechanically secure said at least one side trim piece to said top cap.

31. The method of joining at least one side trim piece to a plurality of partition panels having adjacent frame ends as set forth in claim 29, wherein:

said step of registering the at least one side trim piece includes registering a plurality of side trim pieces; and said step of securing the at least one side trim piece includes securing a plurality of side trim pieces.

32. The method of joining at least one side trim piece to a plurality of partition panels having adjacent frame ends as set forth in claim 31, further including:

inserting at least one downwardly depending connector tab of the top cap into at least one aperture defined by the side trim pieces and a top trim piece to connect the top cap to the side trim pieces and the top trim piece.

33. The method of joining at least one side trim piece to a plurality of partition panels having adjacent frame ends as set forth in claim 31, further including:

inserting a plurality of downwardly depending connector tabs of the top cap into a plurality of apertures defined by the plurality of side trim pieces to connect said top cap to the plurality of side trim pieces.

34. The method of joining at least one side trim piece to a plurality of partition panels having adjacent frame ends as set forth in claim 28, further including:

enclosing an associated open top of the panels with at least one top trim piece; and engaging an in-line connector with the at least one top trim trip piece.

35. The method of joining at least one side trim piece to a plurality of partition panels having adjacent frame ends as set forth in claim 28, wherein:

said step of securing the at least one side trim piece to the connector bracket includes connecting at least one attachment flange on the at least one side trim piece to the connector bracket.

36. The method of joining at least one side trim piece to a plurality of partition panels having adjacent frame ends as set forth in claim 28, further including:

attaching the vertically registering bracket to an uppermost one of the connector brackets.

37. A trim kit for partition panels of the type having adjacent frame ends interconnected by vertically spaced connector brackets to define a post-simulating joint, comprising:

a locator bracket shaped to be attached to an uppermost one of said connector brackets, and including upstanding side walls with an outward extending upper tab;

a trim strip shaped to enclose an associated open side of the post-simulating joint and including an inwardly protruding top tab, said top tab for mating and abutting said upper tab of said locator bracket to positively locate said trim strip with respect to the adjacent frame ends; and a top cap shaped to enclose a top portion of the post-simulating joint, and for being abuttingly supported on said top tab of said trim strip to positively locate said top cap.

* * * * *

UNITED STATES PATENT AND TRADEMARK OFFICE

CERTIFICATE OF CORRECTION

PATENT NO. : 6,415,567 B1
DATED : July 9, 2002
INVENTOR(S) : Karl J. Mead et al.

It is certified that error appears in the above-identified patent and that said Letters Patent is hereby corrected as shown below:

Column 2,
Line 48, delete “the”.

Column 3,
Line 26, “includes” should be -- including --.
Line 28, “brackets” should be -- bracket --.

Column 4,
Line 57, “tie” should be -- the --.

Column 6,
Line 10, “perpendicularly” should be -- perpendicular --.
Line 24, after “middle” insert -- of --.

Column 12,
Line 16, after “strip” delete “. (period)”.

Column 17,
Line 36, “connected” should be -- connector --.

Column 18,
Line 3, delete “side”.

Column 20,
Line 9, delete “trip”.

Signed and Sealed this

Eighth Day of June, 2004

JON W. DUDAS
*Acting Director of the United States Patent and Trademark Office*